US010859340B2

(12) United States Patent
Khoshnood

(10) Patent No.: US 10,859,340 B2
(45) **Date of Patent: *Dec. 8, 2020**

(54) CROSSBOW WITH A RELEASE MECHANISM

(71) Applicant: MCP IP, LLC, Sparta, WI (US)

(72) Inventor: Bahram Khoshnood, Cumming, GA (US)

(73) Assignee: MCP IP, LLC, Sparta, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/405,858

(22) Filed: May 7, 2019

(65) Prior Publication Data

US 2019/0265001 A1 Aug. 29, 2019

Related U.S. Application Data

(63) Continuation of application No. 15/174,848, filed on Jun. 6, 2016, now Pat. No. 10,281,230, which is a continuation of application No. 14/088,001, filed on Nov. 22, 2013, now Pat. No. 9,360,268.

(51) Int. Cl.

| | |
|---|---|
| ***F41B 5/14*** | (2006.01) |
| ***F41B 5/10*** | (2006.01) |
| ***F41B 7/04*** | (2006.01) |
| ***F41B 5/12*** | (2006.01) |

(52) U.S. Cl.

CPC ..... *F41B 5/1469* (2013.01); *F41B 5/10* (2013.01); *F41B 5/12* (2013.01); *F41B 7/046* (2013.01)

(58) Field of Classification Search

CPC ..... F41B 5/12; F41B 7/046

USPC ..... 124/25

See application file for complete search history.

(56) References Cited

U.S. PATENT DOCUMENTS

| | | | |
|---|---|---|---|
| 3,670,711 | A | 6/1972 | Firestone |
| 4,030,473 | A | 6/1977 | Puryear |
| 4,169,456 | A | 10/1979 | Van House |
| 4,192,281 | A | 3/1980 | King |
| 4,388,914 | A | 6/1983 | Cesin |
| 4,479,480 | A | 10/1984 | Holt |
| 4,662,345 | A | 5/1987 | Stephens |
| 4,665,886 | A | 5/1987 | Barlow |
| 4,688,539 | A | 8/1987 | Lawrence |
| 4,693,228 | A | 9/1987 | Simonds et al. |
| 4,697,571 | A | 10/1987 | Walser |
| 4,716,880 | A | 1/1988 | Adkins |
| 4,721,092 | A | 1/1988 | Walser |

(Continued)

*Primary Examiner* — Jeffrey S Vanderveen

(57) ABSTRACT

A trigger mechanism for use in a crossbow having a bowstring, the trigger mechanism comprising a housing having a slot formed therein, a trigger lever pivotally mounted in the housing and having a trigger that extends partially outside the housing, a catch pivotally mounted in the housing, and a disarm mechanism received in the housing that is moveable between a neutral first position and a disarm second position. The catch has a first end configured to retain the bowstring in a cocked position and a second end configured to operatively engage the trigger lever. When the disarm mechanism is in the disarm second position and the user draws the bowstring further into the housing slot, the trigger mechanism is configured to allow the catch to move from the catch first position into the catch second position without requiring the user to engage the trigger (e.g., squeezing or pulling the trigger).

18 Claims, 15 Drawing Sheets

(56) References Cited

U.S. PATENT DOCUMENTS

| | | | | |
|---|---|---|---|---|
| 4,877,008 | A | 10/1989 | Troubridge | |
| 5,025,771 | A | 6/1991 | Hanson | |
| 5,085,200 | A | 2/1992 | Horton-Corcoran | |
| 5,243,956 | A * | 9/1993 | Luehring | F41B 5/12 124/25 |
| 5,596,976 | A | 1/1997 | Waiser | |
| 5,598,829 | A * | 2/1997 | Bednar | F41A 17/28 124/25 |
| 5,649,520 | A | 7/1997 | Bednar | |
| 5,884,614 | A | 3/1999 | Darlington | |
| 6,205,990 | B1 | 3/2001 | Adkins | |
| 6,425,386 | B1 | 7/2002 | Adkins | |
| 6,736,123 | B1 | 5/2004 | Summers | |
| 6,799,566 | B1 | 10/2004 | Malucelli | |
| 6,802,304 | B1 | 10/2004 | Chang | |
| 7,017,568 | B1 | 3/2006 | Smith | |
| 7,174,884 | B2 | 2/2007 | Kempf | |
| 7,588,022 | B2 | 9/2009 | Chang | |
| 7,770,567 | B1 | 8/2010 | Yehle | |
| 7,779,824 | B2 | 8/2010 | Bednar | |
| 7,784,453 | B1 | 8/2010 | Yehle | |
| 7,810,480 | B2 | 10/2010 | Shepley | |
| 7,814,894 | B2 | 10/2010 | Giroux | |
| 7,997,258 | B2 | 8/2011 | Shepley | |
| 8,020,543 | B2 | 9/2011 | Maleski | |
| 8,091,540 | B2 | 1/2012 | Matasic | |
| 8,240,299 | B2 | 8/2012 | Kronengold | |
| 8,312,869 | B2 | 11/2012 | Gillet | |
| 8,375,928 | B1 | 2/2013 | Bednar et al. | |
| 8,453,631 | B1 | 6/2013 | Kronengold | |
| 8,522,761 | B1 * | 9/2013 | Chu | F41A 19/10 124/25 |
| 8,602,013 | B2 | 12/2013 | Bednar | |
| 8,651,094 | B2 | 2/2014 | Matasic | |
| 8,656,899 | B2 | 2/2014 | Bednar | |
| 8,770,178 | B2 | 7/2014 | Kempf | |
| 8,857,420 | B2 | 10/2014 | Grace | |
| 8,931,465 | B1 | 1/2015 | Choma | |
| 8,985,091 | B2 | 3/2015 | Miao | |
| 9,010,308 | B1 | 4/2015 | Hyde | |
| 9,354,018 | B2 | 5/2016 | Khoshnood | |
| 9,360,268 | B2 | 6/2016 | Khoshnood | |
| 9,435,605 | B2 | 9/2016 | McPherson et al. | |
| 10,281,230 | B2 | 5/2019 | Khoshnood | |
| 2008/0060629 | A1 | 3/2008 | Chang | |
| 2009/0064978 | A1 | 3/2009 | Matasic | |
| 2009/0078243 | A1 | 3/2009 | Bednar | |
| 2012/0048252 | A1 | 3/2012 | Chu | |
| 2013/0098343 | A1 | 4/2013 | Grace | |
| 2013/0312724 | A1 | 11/2013 | Hudkins | |
| 2014/0076296 | A1 | 3/2014 | Kempf | |
| 2014/0102431 | A1 | 4/2014 | Kennedy | |
| 2014/0182574 | A1 | 7/2014 | Darlington | |
| 2014/0246003 | A1 * | 9/2014 | Lipowski | F41A 17/46 124/25 |

* cited by examiner

CROSSBOW WITH A RELEASE MECHANISM

CROSS-REFERENCE TO RELATED APPLICATIONS

This application is a Continuation of U.S. patent application Ser. No. 15/174,848, filed Jun. 6, 2016, which is a Continuation of U.S. patent application Ser. No. 14/088,001, filed Nov. 22, 2013, the entire content of which is hereby incorporated herein by reference.

BACKGROUND

The present invention relates generally to crossbows and in particular to a release mechanism for un-cocking a crossbow.

Crossbows have been used since the Middle Ages. Crossbows have evolved to include cams and synthetic split limbs that greatly increase firing velocity. However, increased firing velocity creates a problem when a crossbow is dry-fired in order to release the bowstring from a cocked position into an un-cocked position without firing a bolt or arrow. Unloaded or dry firing impacts can damage the bowstring, limbs, cams and other components. Dry firing also creates a safety concern.

SUMMARY

In one embodiment, a trigger mechanism for use with a crossbow having a bowstring comprises (1) a housing having a slot formed therein; (2) a trigger lever pivotally mounted in the housing, where the trigger lever comprises a trigger that extends partially outside the housing; (3) a catch that is pivotally mounted in the housing; and (4) a disarm mechanism that is moveable between a neutral first position and a disarm second position. The catch has a first end that is configured to retain the bowstring in a cocked position and a second end that is configured to operatively engage with the trigger lever. When the disarm mechanism is in a neutral first position and the trigger is engaged by a user (e.g., the trigger is squeezed by the users hand), the trigger mechanism is configured so that the trigger lever allows the catch to move from a first position in which the catch first end retains the bowstring in the cocked position into a second position in which the catch first end releases the bowstring thereby allowing the crossbow to fire. Additionally, when the disarm mechanism is in moved into the disarm second position, the trigger mechanism is configured so that the trigger lever allows the catch to move from the catch first position into the catch second position without requiring the user to engage the trigger.

In still another embodiment, a crossbow comprises (1) an elongated body has a first end and an opposite second end; (2) a first limb coupled to the elongated body first end; (3) a second limb coupled to the elongated body first end; (4) a bowstring having a first end operatively coupled to the first limb and an second end operatively coupled to the second limb; (5) a trigger lever rotatably coupled to the elongated body intermediate the elongated body first and second ends; (6) a catch rotatably coupled to the elongated body intermediate the elongated body first and second ends; and (7) a disarm mechanism that is moveable between a neutral first position and a disarm second position. The trigger lever comprises a trigger that at least partially extends from the elongated body and that is configured to fire the cross bow when the user pulls on the trigger with the users finger. Furthermore, the catch has a first end that is configured to retain the bowstring in a cocked position and a second end that is configured to operatively engage the trigger lever. When (1) the disarm mechanism is in the neutral first position, (2) the bowstring is in the cocked position, and (3) the trigger is engaged by a user, the trigger lever is configured to allow the catch to move from a first position in which the catch first end retains the bowstring in the cocked position into a second position in which the catch first end releases the bowstring (e.g., the crossbow is fired). Finally, when the disarm mechanism is in the disarm second position and the bowstring is in the cocked position, the trigger lever is configured to allow the catch to move from the catch first position into the catch second position without requiring the user to engage the trigger (e.g., pull the trigger, squeeze the trigger or physically touch the trigger) by drawing the bowstring further into the housing slot.

BRIEF DESCRIPTION OF THE DRAWINGS

Having described various embodiments in general terms, reference will now be made to the accompanying drawings, which are not necessarily drawn to scale, and wherein.

DETAILED DESCRIPTION OF VARIOUS EMBODIMENTS

Various embodiments will now be described more fully herein with reference to the accompanying drawings, in which various relevant embodiments are shown. The invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Overview

Figure 1:
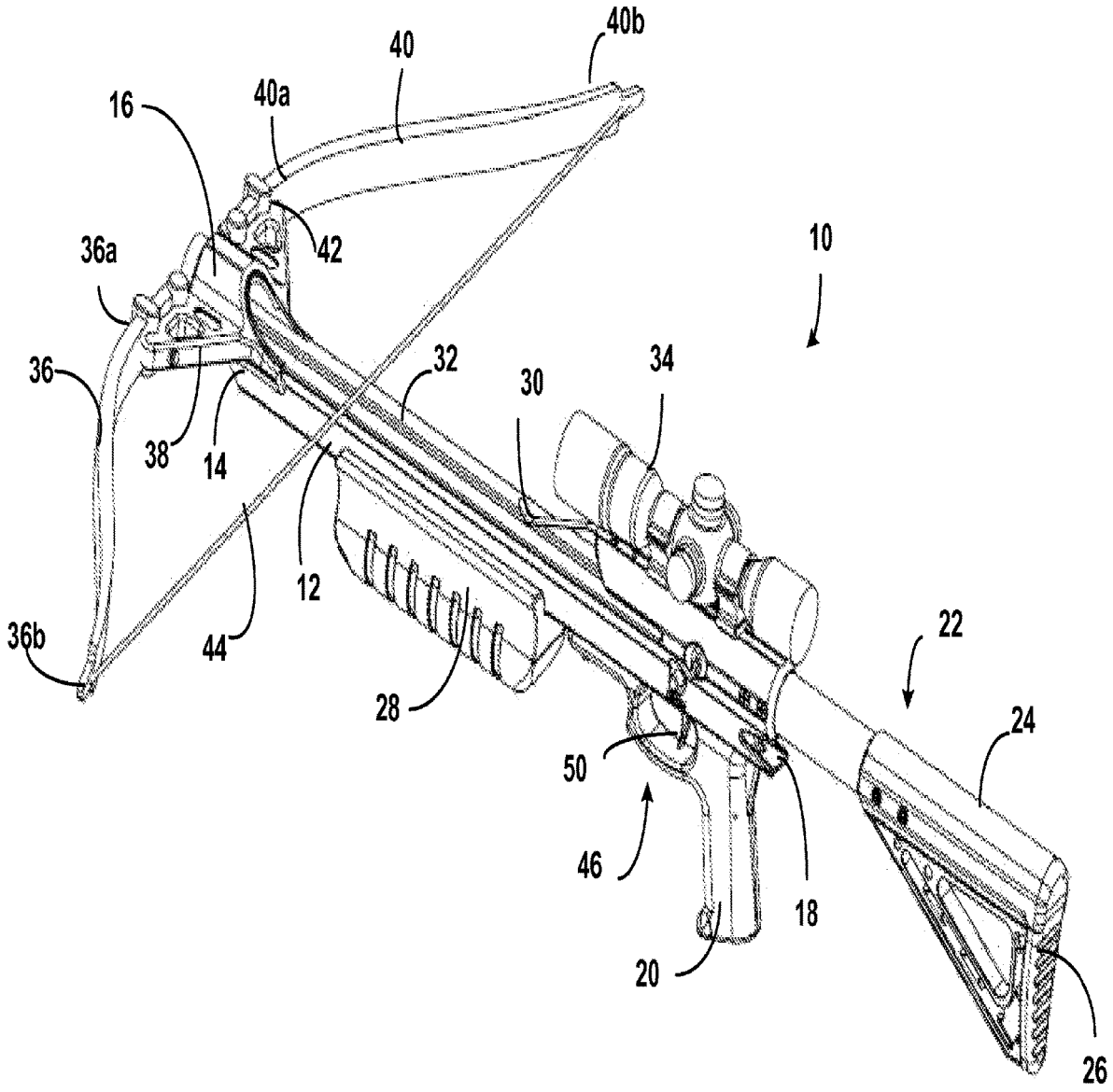
FIG. 1 is a perspective view of an embodiment of a crossbow.

Referring to FIG. 1, a crossbow 10 is shown having a barrel 12, which has a first end 14 coupled to a riser 16 and a second end 18 coupled to a pistol grip 20, and a stock 22. The stock 22 has a comb 24 and a butt 26. In the embodiment shown, the stock length is adjustable, but in other embodiments the stock may have a fixed length. A grip 28 is coupled to the barrel 12 intermediate the first and second ends 14 and 18. A retention spring 30 is operatively coupled to a top surface 32 of the barrel 12. A scope 34 is also operatively coupled to the barrel top surface 32. A first limb 36 has a first side 36*a* operatively coupled to a left side 38 of the riser 16 and a second side 36*b* operatively coupled to a bowstring 44. A second limb 40 has a first end 40*a* that is operatively coupled to a right side 42 of the riser and a second end 40*b* that is operatively coupled to the bowstring 44. A trigger mechanism 46 is located within the pistol grip 20 and the barrel 12.

Figure 2:
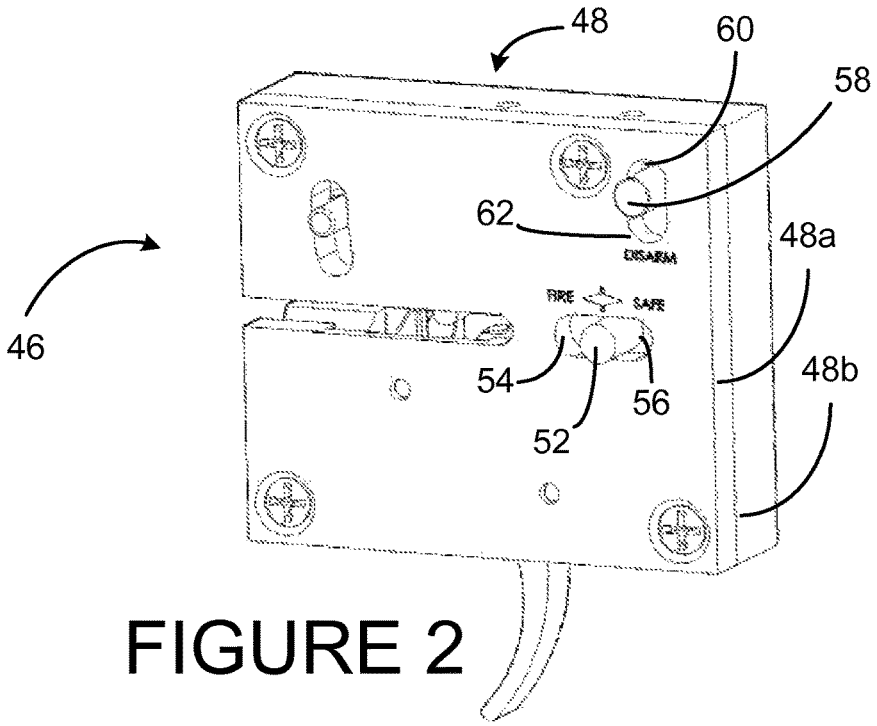
FIG. 2 is a perspective view of an embodiment of a trigger mechanism for use with the crossbow of FIG. 1.

Referring to FIG. 2, the trigger mechanism 46 contains a two piece housing 48 having a first housing portion 48*a* and a second housing portion 48*b* that together enclose the various parts of the trigger mechanism. The trigger mechanism 46 contains a trigger 50 that extends (completely, partially or not at all) from the bottom of the housing 48 and into the pistol grip 46 (FIG. 1). In various embodiments, the trigger may be integrally formed with the trigger lever, or in other embodiments, the trigger may be connected to the trigger lever using any suitable fastener (e.g., a bolt, a pin, a rivet, weldments, etc.) The trigger mechanism 46 also contains a first safety switch 52 that is slidable between a first fire position 54 and a second safety position 56. Additionally, the trigger mechanism is also equipped with a disarm switch 58 that is slidable between a first neutral position 60 and a second disarm position 62. The second disarm position 62 allows a user to de-cock the crossbow without having to dry fire the weapon. That is, the disarm switch allows a single user to release the bowstring in a controlled manner without assistance from a third party and without firing the crossbow by engaging the trigger.

Trigger Mechanism

Figure 3:
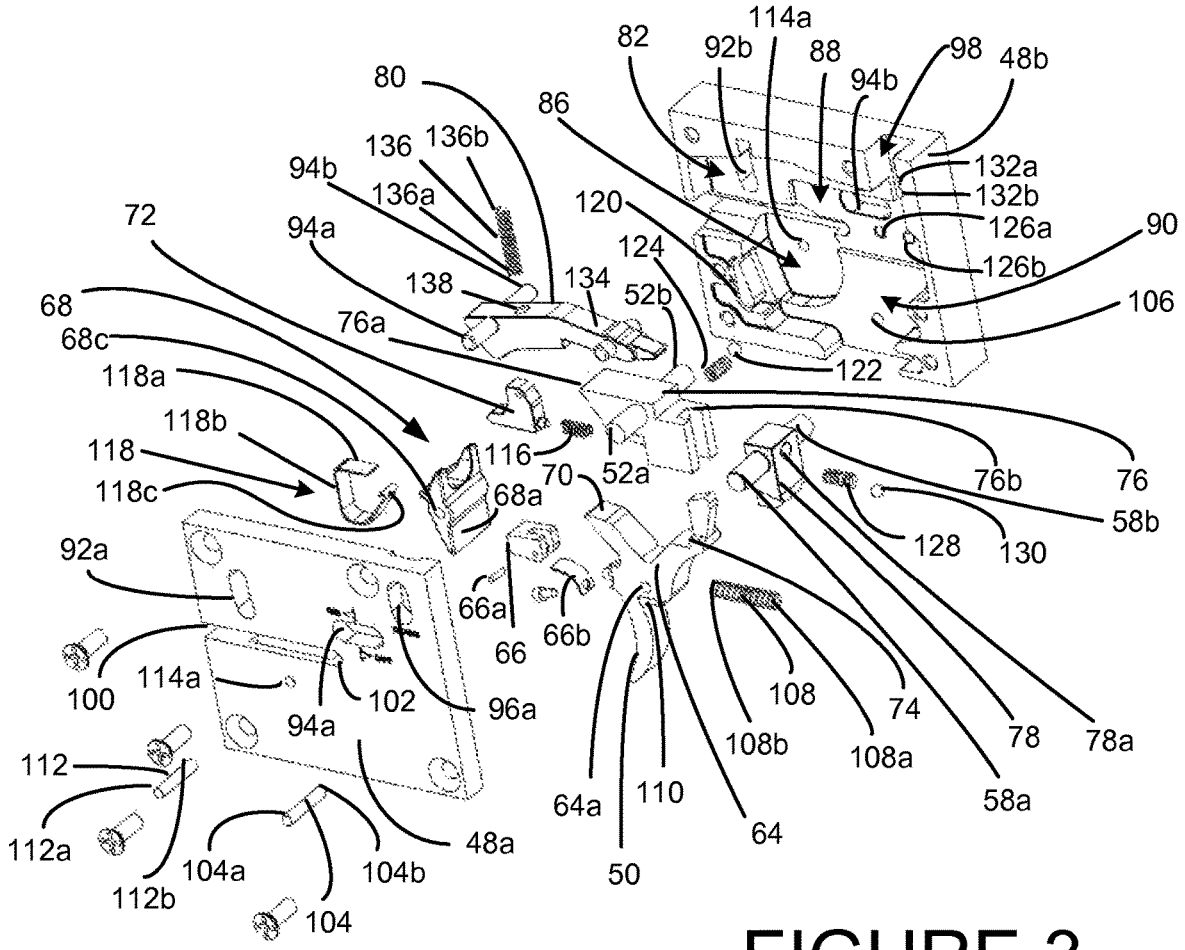
FIG. 3 is an exploded view of the trigger mechanism of FIG. 2.

Referring to FIG. 3, one embodiment of a trigger mechanism is shown. In particular, the trigger mechanism 46 comprises a trigger 50 coupled to a trigger lever 64 that has a first arm 66 operatively engaged with a catch 68. First arm 66 is pivotally coupled to the trigger lever 64 by a pin 66*a*. A flat spring 66*b* has a first end operatively coupled to the trigger lever 64 and a second end that biases the first arm 66 upward with respect to the trigger 50. A second arm 70 that operatively engages with a rotating lever 72, and a third arm 74 that operatively engages with both a safety block 76 and a disarm block 78. The safety block 76 is also operatively coupled to a pivoting dry-fire safety lever 80. Housing portion 48*b* contains a first recessed area 82 that receives the pivoting dry-fire safety lever 80. A second recess 84 slidably receives the disarm block 78. A third recessed area 86 receives the catch 68, and a fourth recessed area 88 slidably receives the safety block 76. Finally, a fifth recessed area 90 receives the trigger lever 64. It should be understood that the housing portion 48*a* contains corresponding recesses that align with their respective recesses formed in housing portion 48*b*.

The first and second housing portions 48*a* and 48*b* are generally square shaped and made from aluminum. In various embodiments, the housing 48 may be formed in any shape (e.g., rectangular, polygonal, oval, etc.) and may be formed from any suitable material (e.g., alloy, stainless steel, ceramic, polymers, etc.). In some embodiments, a cavity formed in the elongated body may function as the housing that receives the various parts of the trigger mechanism. Each housing portion 48*a* and 48*b* contains a first elongated slot 92*a* and 92*b* that open into the recess 82 and are configured to slidably receive there though respective pins 94*a* and 94*b* that are formed on the dry-fire safety lever 80. A second set of elongated slots 96*a* and 96*b* open into recess 88 and are configured to slidably receive the respective pins 52*a* and 52*b*, which are formed on the safety block 76. Finally, a third set of elongated slots 96*a* and 96*b* (only 96*a* is shown in the figure) open into a recess 98 (formed in each of housing portions 48*a* and 48*b*) and are configured to receive the respective pins 58*a* and 58*b*, which are formed on the disarm block 78. A bowstring slot 100 is formed through one side of each housing portion 48*a* and 48*b* and terminates proximate a housing center 102 adjacent the bowstring catch 68.

Trigger lever 64 is pivotally mounted in recess 90 by a pin 104 that passes through a bore 64*a* formed through the trigger lever 64. That is, a first end 104*a* of the pin is received in a blind bore (not shown) formed in first housing portion 48*a*, and a second end 104*b* of the pin 104 is received in a blind bore 106 formed in the second housing portion 48*b*. A spring 108 has a first end 108*a* that engages an inside wall of the second housing portion 48*b*, and a second end 108*b* that is received on a pin 110 formed proximate to the area where trigger 50 couples to the trigger lever 64. In this configuration, trigger 50 is pivotable between a first forward position (e.g., spring 108 biases the trigger forward) in which the first arm 66 abuts against a first end 68*a* of bowstring catch 68, and a second position in which the trigger 50 is rotated counterclockwise against the bias of spring 108.

Catch 68 is pivotally mounted in recess 86 by a pin 112 that passes through a through-hole 68*c*. A first end 112*a* of the pin is received in a hole 114*a* formed through the first housing portion wall, and a second end 112*b* of pin 112 is received in a hole 114*b* formed through the second housing portion wall. The second end (not numbered) of catch 68 is "U" shaped. The "U" shaped end allows a bolt (not shown) to be knocked on the bowstring without interfering with the bolt when the bowstring is pulled back and the crossbow is cocked. A flat spring 118 is positioned intermediate the catch first end 68*a* and the wall of the second housing portion 48*b*. More particularly, a first end 118*a* and an intermediate part 118*b* of the flat spring 118 are received in a groove 120 formed in the housing second portion 48*b*. A second end 118*c* of the flat spring 118 is positioned adjacent the first end 68*a* of the catch 68 and biases the bowstring catch first end 68*a* into engagement with the first arm 66 of the trigger lever 64.

The safety block 76 is slidably received in the recess 88 such that (1) pin 52*a* aligns with, and extends through, slot 94*a* formed in first housing portion 48*a*, and (2) pin 52 aligns with, and extends through, slot 94*b* formed in second housing portion 48*b*. A first end 76*a* of the safety block 76 defines a recess (not shown in FIG. 3) that is configured to pivotally receive the rotating lever 72. A spring 116, positioned intermediate the safety block 76 and the rotating lever 72, is configured to bias the rotating lever in a clockwise direction about a pivot point (not numbered). The safety block 76 is moveable between the fire position 54 (FIG. 2) and the second safety position 56 (FIG. 2). The safety block 76 is maintained in the first and second positions by a spring loaded ball 122 and spring 124 that are operatively received in a blind bore (not shown) formed in the side of the safety block 76. The ball 122 is configured to engage with one of two semispherical bores 126*a* and 126*b* formed in a wall that defines the recess 88.

The disarm block 78 is slidably received in the recess 98 such that (1) pin 58 aligns with, and extends through, slot 96*a* formed in the first housing portion 48*a*, and (2) pin 58*b* aligns with, and extends through, the slot (not shown) in the second housing portion 48*b*. The disarm block 78 is slidable between the first neutral position 60 (FIG. 2) and the second disarm position 62 (FIG. 2). The disarm block is maintained in either the first or second positions by a spring 128 and a spring loaded ball 130 are operatively received in a blind bores 78*a* formed in the disarm block 78. The spring loaded ball 130 operatively engages one of two semispherical bores 132*a* and 132*b* formed in a side wall of the recess 98, which locks the disarm block in one of the neutral or disarm positions.

Finally, the dry-fire safety lever 80 is pivotally received in recess 82 such that pin 94*a* aligns with, and is received through, slot 92*a* in the first housing portion 48*a*, and pin 94*b* aligns with, and is received through, slot 92*b* formed in the second housing portion 48*b*. A first end 134 of the dry-fire safety lever 80 is pivotally connected by a pin (not numbered) that are received in blind bores (not shown) formed in the walls of the recess 82 in the first and second housing portions 48*a* and 48*b*. A spring 136 has a first end 136*a* that is received in a blind bore 138 formed in the dry-fire safety lever 80 and a second end that engages a wall (not numbered) of the recess 82.

Exemplary Trigger Mechanism Operation

FIGS. 4-9 show an exemplary trigger mechanism 46. While trigger mechanisms exist in many guns and weapons, in this exemplary embodiment, the trigger mechanism 46 provides a release mechanism that allows a user to release a cocked crossbow without having to dry fire the weapon or engage the trigger with the user's hand. That is, the user does not have to activate the trigger to un-cock the crossbow.

Cocking the Crossbow

Figure 4:
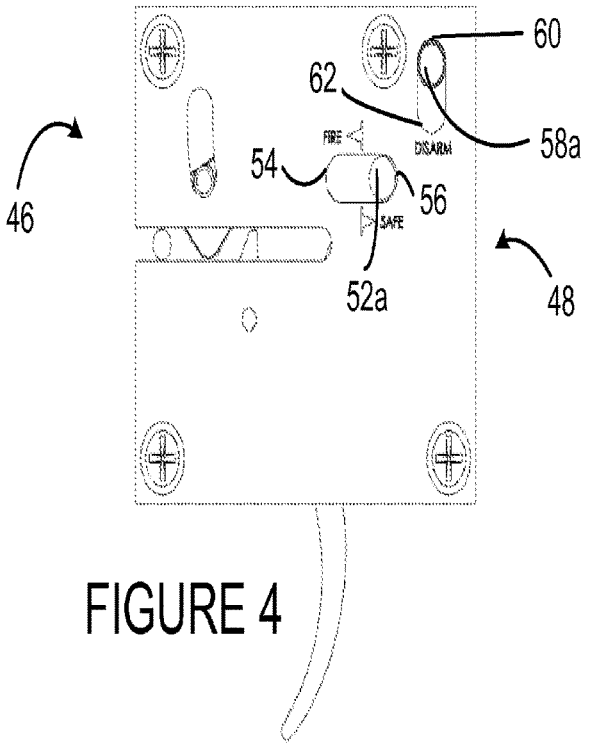
FIG. 4 is a front plan view of an embodiment of a trigger mechanism of FIG. 2.
Figure 5:
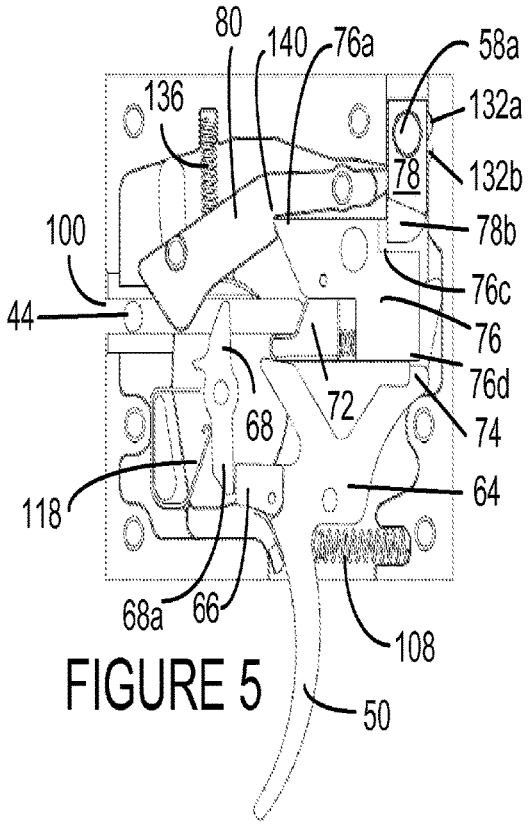
FIG. 5 is a partial sectional view of the trigger mechanism of FIG. 2, in a first position.

Specifically referring to FIG. 4, the trigger mechanism 46 is shown with the disarm pin 58*a* in the neutral position 60, and the safety pin 52*a* in a safety position 56. Referring to FIG. 5, the trigger mechanism of FIG. 4 is shown with the housing first portion 48*a* removed. In the present configuration, the ball 130 (FIG. 3) is engaged in the recesses 132*a*, and the ball 122 (FIG. 3) is engaged in recess 126*b* (FIG. 3). The bowstring 44 is shown positioned just inside the opening of slot 100 as the user is moving the bowstring into a cocked position.

The flat spring 118 biases the bowstring catch 68 in the counterclockwise direction until the first end 68*a* abuts the trigger lever first arm 66, and the spring 108 biases the trigger lever 64 in a clockwise direction. The dry-fire safety lever 80 is biased downward by spring 136 so that a detent 140 formed in the dry-fire safety lever 80 receives a tip (not numbered) of the safety block first end 76*a*, and a first end 78*b* of the disarm block 78 is received in a cutout 76*c* of the safety block 76. Finally, because the safety block is in the safety position, the trigger lever third arm 74 abuts a bottom edge 76*d* of the safety block thereby preventing the trigger lever 64 from rotating in the counterclockwise direction.

Figure 6:
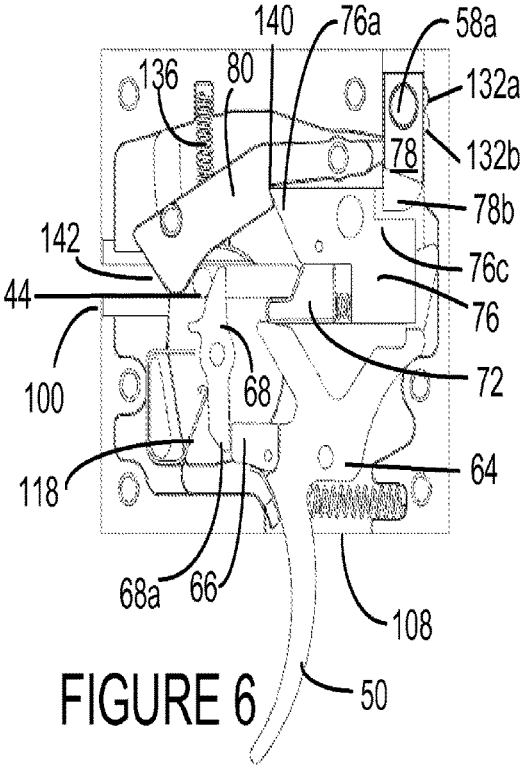
FIG. 6 is a partial sectional view of the trigger mechanism of FIG. 2, in a second position.
Figure 7:
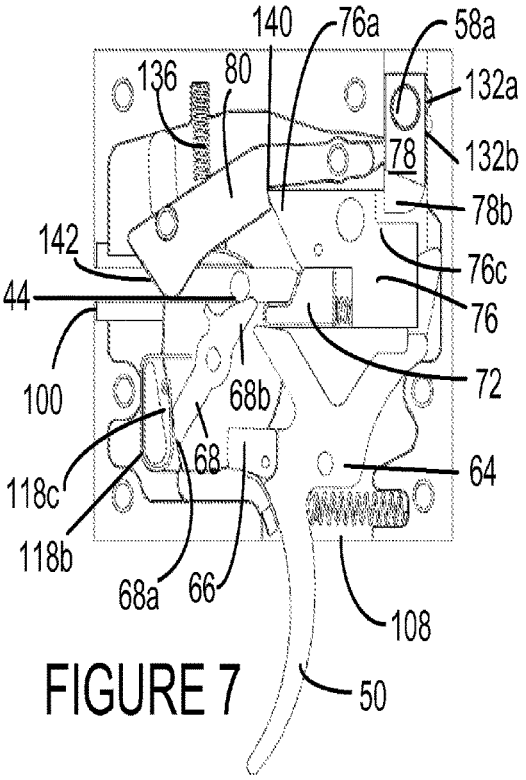
FIG. 7 is a partial sectional view of the trigger mechanism of FIG. 2, in a third position.

Referring to FIG. 6, as the bowstring is moved further into slot 100, the knocked on the bowstring pushes against a slanted face 142 of dry-fire safety lever 80 thereby pushing the dry-fire safety lever 80 slightly upward against the downward bias of spring 136. Referring to FIG. 7, as the bowstring 44 is pulled further into the slot 100, the bowstring begins to engage the second end 68*b* of the catch 68 causing the catch to rotate clockwise. As the catch 68 rotates clockwise, the catch first end 68*a* pushes against the flat spring second end 118*c* thereby compressing the flat spring second 118*c* toward the flat spring body 118*b*.

Figure 8:
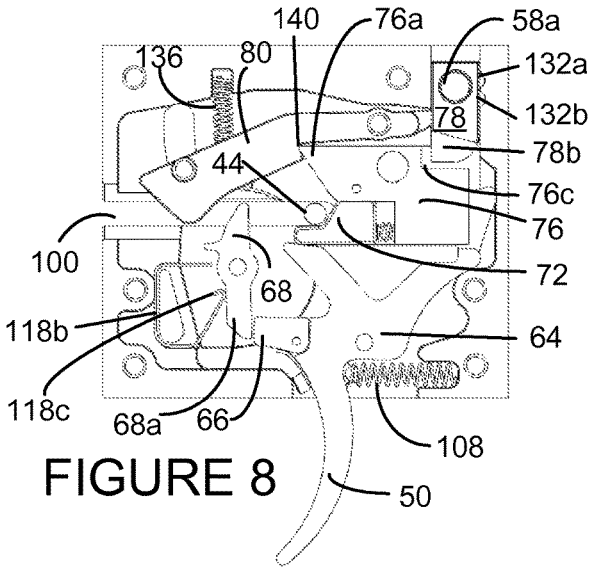
FIG. 8 is a partial sectional view of the trigger mechanism of FIG. 2, in a fourth position.
Figure 9:
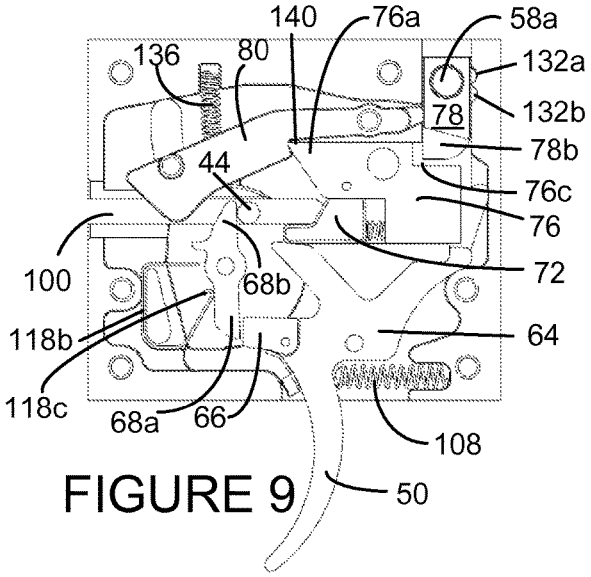
FIG. 9 is a partial sectional view of the trigger mechanism of FIG. 2, in a fifth position.
Figure 10:
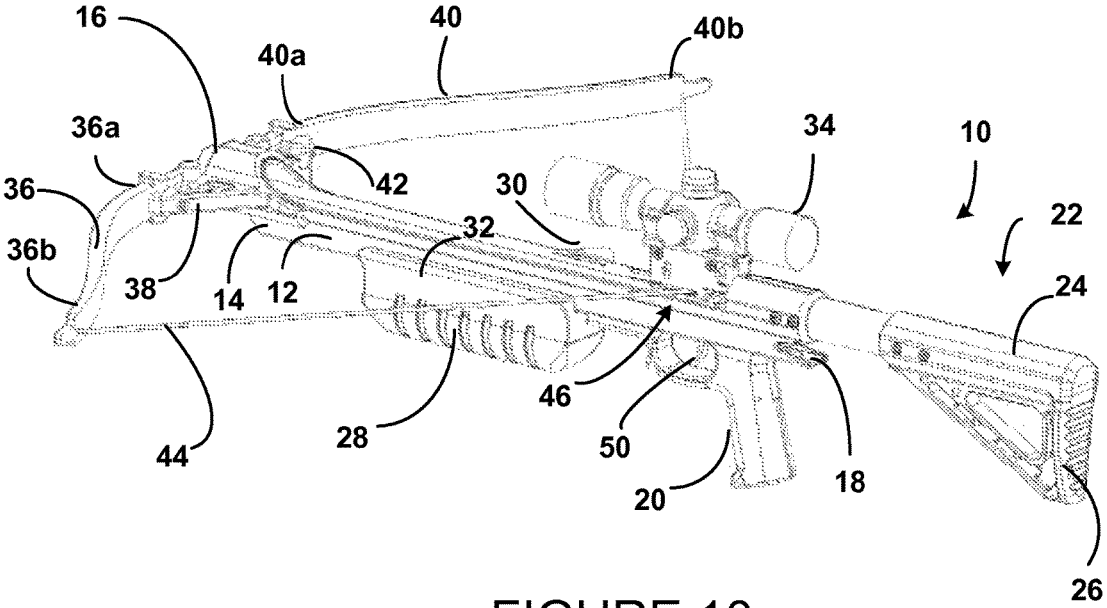
FIG. 10 is a perspective view of the crossbow of FIG. 1 in a cocked position.

Referring to FIG. 8, once the bowstring 44 passes the catch 68 and is pulled back against the rotating lever 72, the catch is allowed to rotate in the counterclockwise direction as the flat spring second end 118*c* moves away from the flat spring body 118*b*. The catch 68 continues to rotate counterclockwise until the catch first end 68*a* abuts against the trigger lever first arm 66. At this point, the user can release the bowstring 44 since the bowstring is retained in the cocked position by the catch second end 68*b*. That is, referring to FIG. 9, the catch 68 is maintained in a vertical orientation since the bowstring 44 exerts force in the counterclockwise direction on the catch second end 68*b*, but the trigger lever first arm 66 prevents the catch from rotating since the catch first end 68*a* abuts against the first arm. As a result, a crossbow 10 containing the trigger mechanism 46 shown in FIGS. 2-9 is maintained in a cocked position, as shown in FIG. 10. Moreover, the crossbow 10 is prevented from being fired since the trigger 50 cannot be activated (e.g., pulled, squeezed, etc.) until the safety block 76 is moved from the safety position into the firing position, as described in detail below.

Releasing the Crossbow

Figure 11:
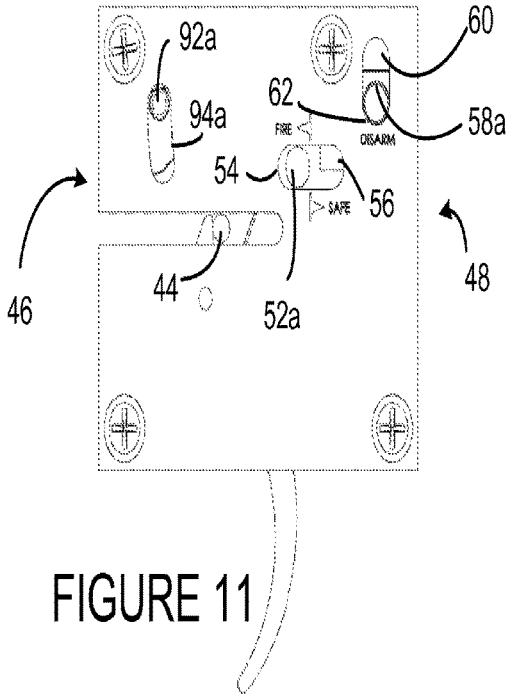
FIG. 11 is a front plan view of the embodiment of the trigger mechanism of FIG. 2, with the safety in a fire position and the release mechanism in a disarm position.
Figure 12:
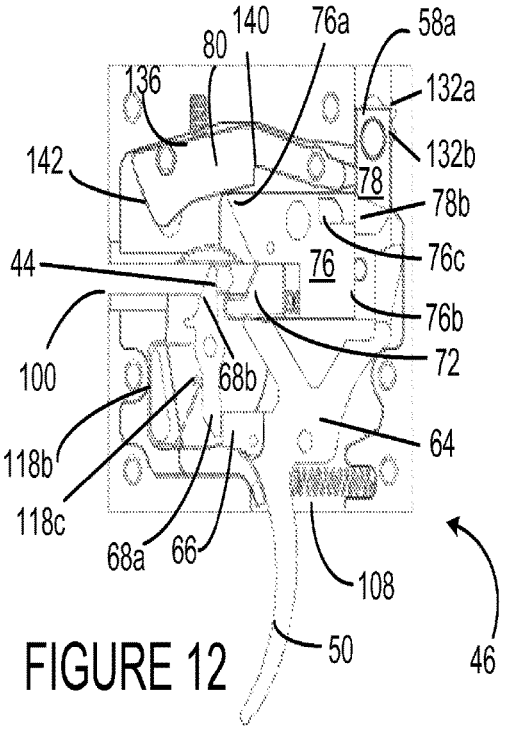
FIG. 12 is a partial sectional view of the trigger mechanism of FIG. 11, in a first position.

Referring to FIGS. 11 and 12, should the user wish to release the bowstring without firing or dry firing the crossbow 10, the user can use the trigger mechanism shown in the figures to release the bowstring 44. For example, if the crossbow is cocked and the user wishes to release the bowstring 44 from the cocked position without firing the crossbow, the user would either remove a bolt (not shown) knocked on the bowstring 44, or if a bolt has not been knocked, the user would either insert and remove a bolt (not shown) in order to move the dry-fire safety lever 80 upward so that the safety block first end 76*a* moves out of engagement with the detent 140 or raise the dry-fire safety lever 80 (FIG. 12) by sliding pin 92*a* upward in slot 94*a* to release the dry-fire safety lever 80. In either case, before the user can place the trigger mechanism into the disarm position, the dry-fire safety lever should be disengaged from the safety block. Once the dry-fire safety lever 80 is disengaged from the safety block 76, the user may slide the safety pin 52*a* from the safety position 56 (FIG. 11) into the fire position 54 (FIG. 11). As the safety block 76 slides to the left (as shown in the Figure), the safety block front end 76*a* slides under the dry-fire safety lever 80 and ball 122 (FIG. 3) moves from recess 126*b* into recesses 126*a* (FIG. 3), which maintains the safety block in the firing position. Finally, once the safety block 76 moves into the firing position, the disarm pin 58*a* is moved from the neutral position 60 (FIG. 11) into the disarm position 62 (FIG. 11), which causes the disarm block to move downward so that the disarm block first end 78*b* moves past the safety block second end 76*b*. Once the disarm block 78 is moved fully into the disarm position, the ball 130 maintains the disarm block in this position as it engages the hemispherical recess 132*b*. Even though the trigger mechanism is in the disarm position, as described above, the crossbow does not fire since catch 68 maintain the bowstring 44 in the cocked position.

Figure 13:
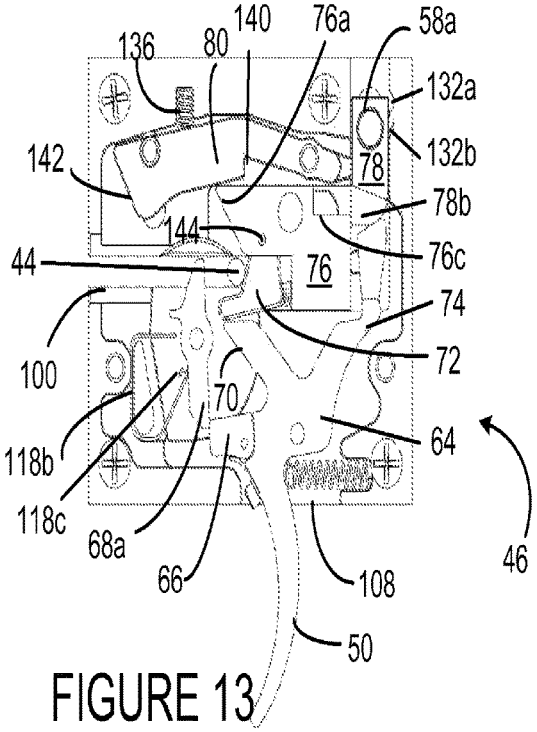
FIG. 13 is a partial sectional view of the trigger mechanism of FIG. 11, in a second position.

Once the various parts of the trigger mechanism are in the position shown in FIG. 12, referring to FIG. 13, the user can draw the bowstring 44 rearward until the bowstring engages the rotating lever 72, which will force the rotating lever to rotate counterclockwise about its pivot point 144. As the rotating lever 72 rotates counterclockwise, it exerts a downward force against the trigger lever second arm 70 thereby causing the trigger lever 64 to also rotate counterclockwise against the force exerted by spring 108 as the spring begins to compress. As the trigger lever 64 rotates counterclockwise, the trigger lever third arm 74 moves up and behind the disarm block 78 into engagement with the disarm block first end 78*b*.

Figure 14:
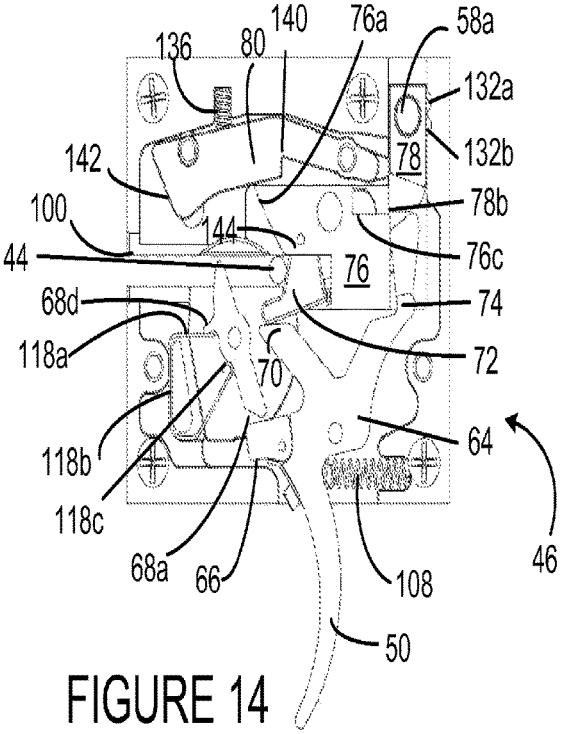
FIG. 14 is a partial sectional view of the trigger mechanism of FIG. 11, in a third position.

Referring to FIG. 14, as the bowstring 44 is pulled even further into slot 100 by the user, the rotating lever 72 pushes the trigger lever second arm 70 further downward out of engagement with the catch first end 68*a*, thereby causing the catch 64 to rotate a sufficient amount in the counterclockwise direction. The catch 64 is allowed to rotate in the counterclockwise direction until a stop 68*d* engages the flat spring first end 118*a*, which stops continued counterclockwise rotation of the catch 64. Additionally, the trigger lever third arm 74 continues to exert an upward force on the disarm block first end 78*b* thereby pushing the disarm block upward into the neutral position. That is, as the upward force increases on the disarm block second end, the force overcomes the spring force exerted on the ball 130 thereby allowing the ball to dislodge from recess 132*b* and reengage recess 132*a* as the disarm block is pushed back into the neutral position where pin 58*a* is adjacent area 60 of the slot 96*a* (FIGS. 2 and 3).

Figure 15:
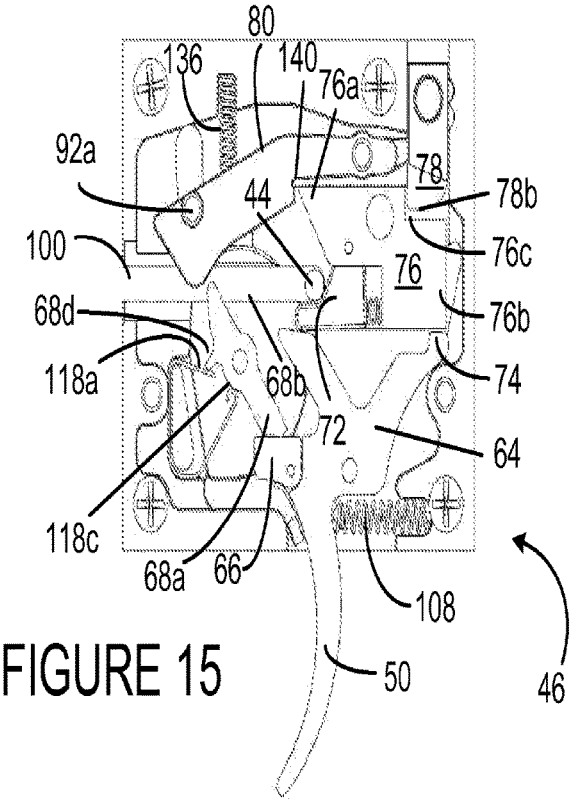
FIG. 15 is a partial sectional view of the trigger mechanism of FIG. 11, in a fourth position.

Once the various components of the trigger mechanism 46 are in the position shown in FIG. 14, referring to FIG. 15, the user can slowly begin to release the bowstring 44 allowing it to move forward toward the bowstring catch second end 68*b*. As the bowstring initially begins to move, the rearward force against rotating lever 72 is removed thereby allowing the trigger lever 64 to begin rotating clockwise from the force exerted by spring 108. As the trigger lever 64 rotates clockwise, trigger lever first arm 66 causes the catch 68 to rotate further in the counterclockwise direction so that the stop 68*d* abuts the flat spring end 118*a* compressing it toward the flat spring body 118*b*. The rotation of the trigger lever 64 also causes the trigger lever third arm 74 to move down and away from the safety block second end 76*b*. As a result, the force exerted against the rotating lever 72 causes the safety block 76 is to slide into the safety position where ball 122 is in engagement with recess 126*a* (FIG. 3). Once the safety block moves into the safety position, safety lever 80 rotates counterclockwise from the force exerted on it by spring 136 so that the safety lever detent 140 once again receives the safety block first end 76*a*. In this position, the safety block is once again prevented from moving out of the safety position until the safety lever is lifted upward using pin 92*a*.

Figure 16:
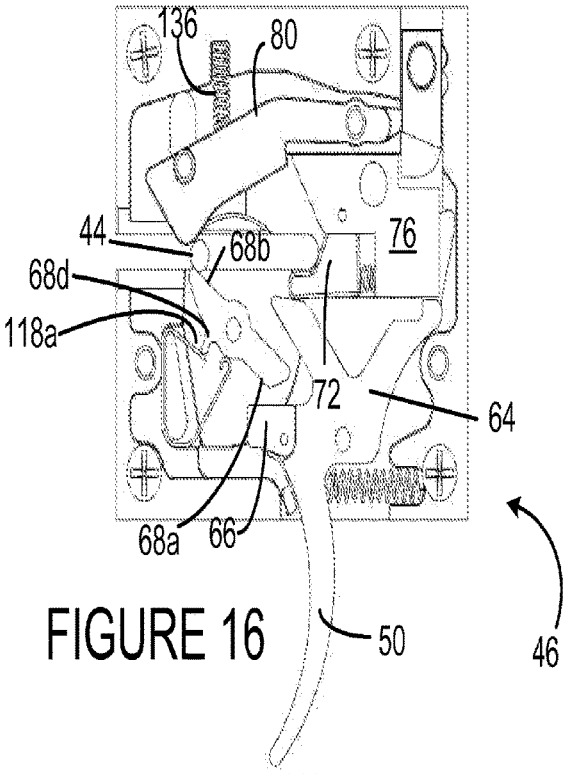
FIG. 16 is a partial sectional view of the trigger mechanism of FIG. 11, in a fifth position.

Referring to FIG. 16, as the bowstring continues to move out of the slot 100, it moves past the catch second end 68*b* and the safety lever 80. Thus, the bowstring 44 causes the catch 68 to rotate slightly in the counterclockwise direction against the bias of flat spring first end 118*a*. Additionally, the safety lever 80 may be slightly biased in the clockwise direction against the force of spring 136 as the bowstring passes underneath the safety lever 80.

Figure 17:
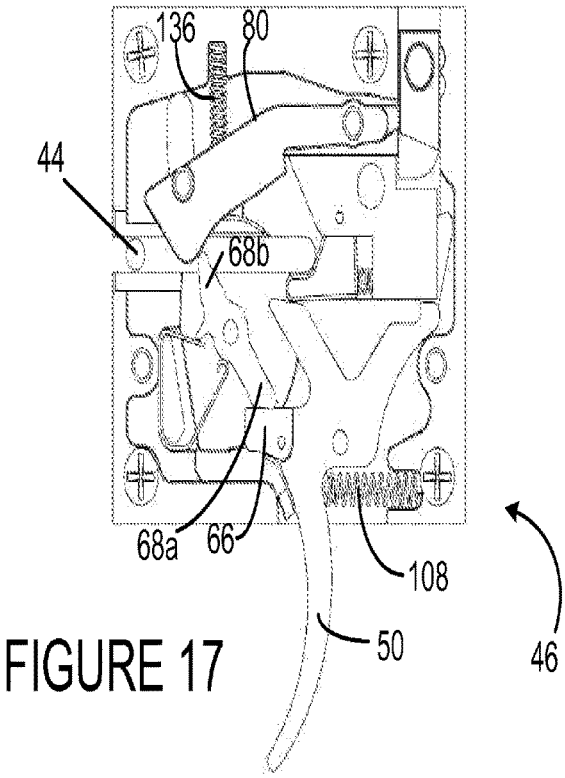
FIG. 17 is a partial sectional view of the trigger mechanism of FIG. 11, in a sixth position.

Referring to FIG. 17, the bowstring 44 may be removed from the slot and allowed to return to the un-cocked position. Although all parts of the trigger mechanism have moved back into their original position seen in FIG. 12, only the catch 68 remains in a different position. That is, the catch first end 68*a* is positioned above the trigger lever first arm 66 instead of abutting the face of the trigger lever first arm, as seen in FIG. 12.

Re-Cocking the Crossbow

Figure 18:
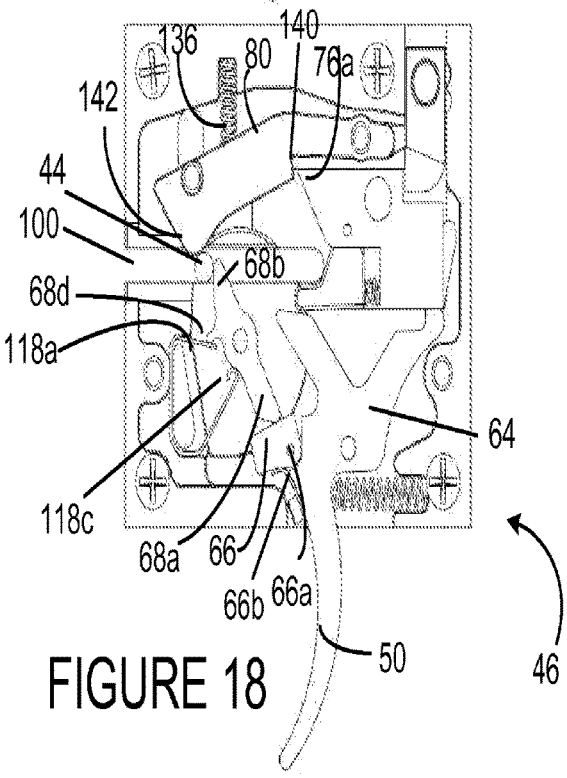
FIG. 18 is a partial sectional view of the trigger mechanism of FIG. 11, in a seventh position.
Figure 19:
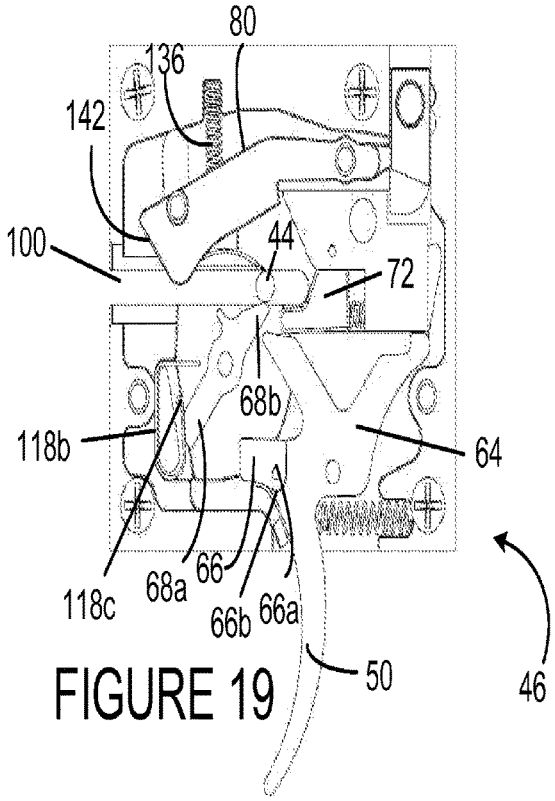
FIG. 19 is a partial sectional view of the trigger mechanism of FIG. 11, in an eighth position.

After the bowstring has been released, the user can re-cock the crossbow 10 by pulling the bowstring 44 back into slot 100, as shown in FIGS. 18 and 19. In particular, as the bowstring 44 is pulled into slot 100, it once again presses against both the safety lever slanted face 142 and the catch second end 68*b*. The force from the bowstring 44 causes both the safety lever 80 and the bowstring catch 68 to rotate clockwise about their pivot points. However, in order for the catch 68 to rotate in the clockwise direction, the catch first end 68*a* exerts a downward force on the trigger lever first arm 66 that is sufficient to cause the first arm 66 to rotate counterclockwise about pin 66*a* against the force of spring 66*b*. The flat spring first end 118*a* also exerts a force against the catch stop 68*d* that assists in rotating the catch 68 in the clockwise direction. As soon as the catch first end 68*a* clears the trigger lever first arm 66, the force exerted by spring 66*b* causes the first arm 66 to rotate counterclockwise back into its resting position.

Figure 20:
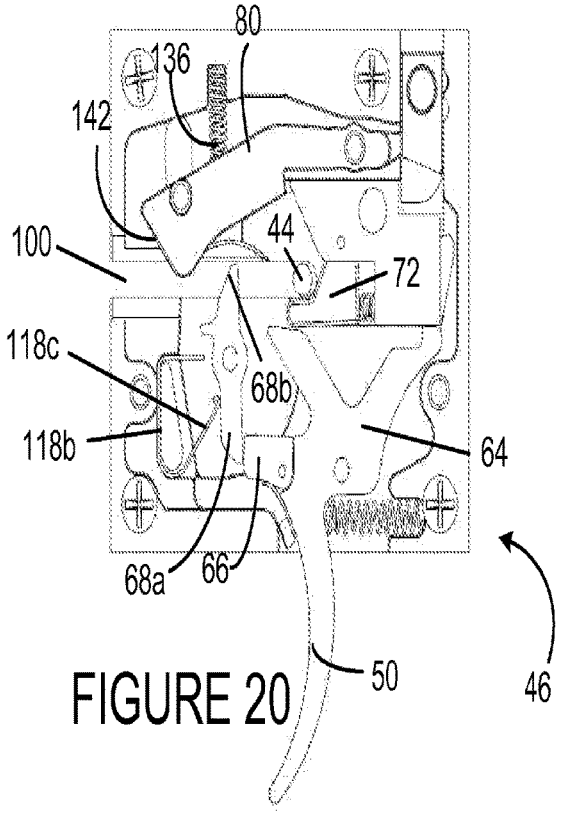
FIG. 20 is a partial sectional view of the trigger mechanism of FIG. 11, in a ninth position.
Figure 21:
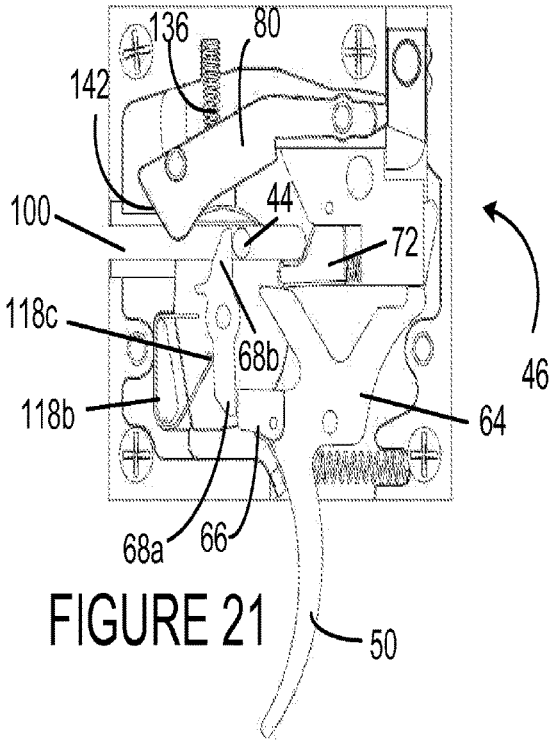
FIG. 21 is a partial sectional view of the trigger mechanism of FIG. 11, in a tenth position.

Referring in particular to FIG. 19, continued movement of the bowstring 44 toward the rotating lever 72 causes the catch first end 68*a* to compress the flat spring second end 118*c* toward the flat spring body 118*b*. In this configuration, the catch first end 68*a* rotates clockwise past the trigger lever first arm 66*a* a sufficient distance to allow the bowstring 44 to move past the catch second end 68*b*. As a result, once the bowstring clears the catch second end 68*b*, the flat spring second end 118*c* biases the catch 68 in the counterclockwise direction until the catch first end 68*a* abuts the trigger lever first arm 66, as shown in FIG. 20. Once the trigger mechanism 46 is in the position shown in FIG. 20, the user can release the bowstring 44, which is maintained in the cocked position by the catch second end 68*b* since the trigger lever first arm 66 prevents the catch first end 68*a* from rotating in the counterclockwise direction.

Second Embodiment

Figure 22:
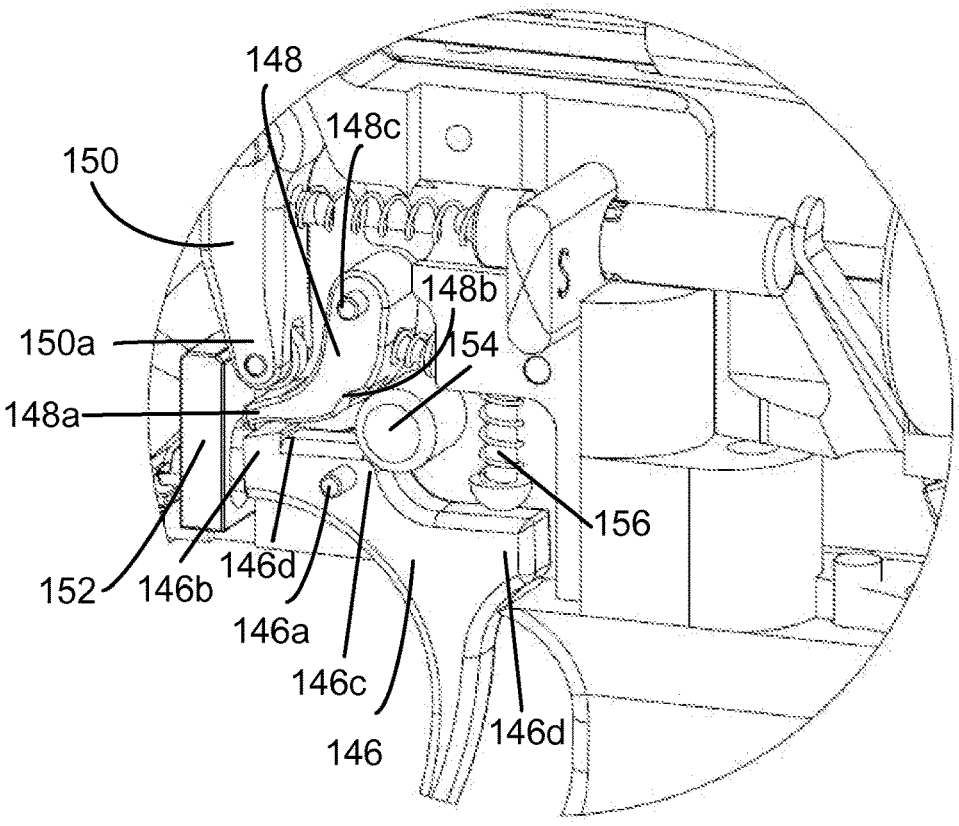
FIG. 22 is a partial perspective view of another embodiment of a trigger mechanism for use in the crossbow of FIG. 1.

Referring to FIG. 22, a second embodiment of a trigger mechanism 46 is shown having a trigger lever 146, a pivoting lever 148 and a catch 150. The trigger mechanism 46 may be contained in a housing similar to FIG. 2, or it may be mounted directly into the stock of the crossbow 10, which serves as the housing. A trigger 146 is pivotally mounted by a pin 146*a* to the housing (not shown). The trigger 146 has a first portion 146*b* in operative engagement with a block 152, a second portion 146*c* in operative engagement with a slidable pin 154, and a third portion 146*d* in operative engagement with a spring loaded plunger 156. The trigger 146 also has a catch (e.g., a detent) 146*d* formed proximate the trigger first portion 146*b* that is configured to receive a first end 148*a* of the pivoting lever 148. The catch 150 has a first end 150*a* in operative engagement with the pivoting lever 148, and a second end 150*b* (FIG. 22) that is configured to retain the bowstring 44 (FIG. 22) when the crossbow 10 is cocked. The slidable pin 154 has a first portion having a first radius and a second portion having a second radius that is smaller than the first radius.

Referring to FIG. 22, in operation, the catch 150 is typically positioned with the catch second end 150*b* up and out of the path that the bowstring 44 travels (which typically corresponds with the slot 100). Thus, as the bowstring 44 is drawn into slot 100 it engages an area (not numbered) of the catch 150 that is proximate the catch first end 150*a* just below the catch pivot point (not numbered), which eventually causes the catch 150 to rotate counterclockwise as the bowstring 44 is drawn deeper into the slot 100. Once the exerted force against the catch first end 150*a* is sufficiently large enough, it causes the catch first end 150*a* to move over a top edge 152*a* of the block 152 causing the block to move vertically downward. Downward movement of the block 152 causes the trigger 146 to rotate slightly counterclockwise against the bias of the spring loaded plunger 156.

Figure 23:
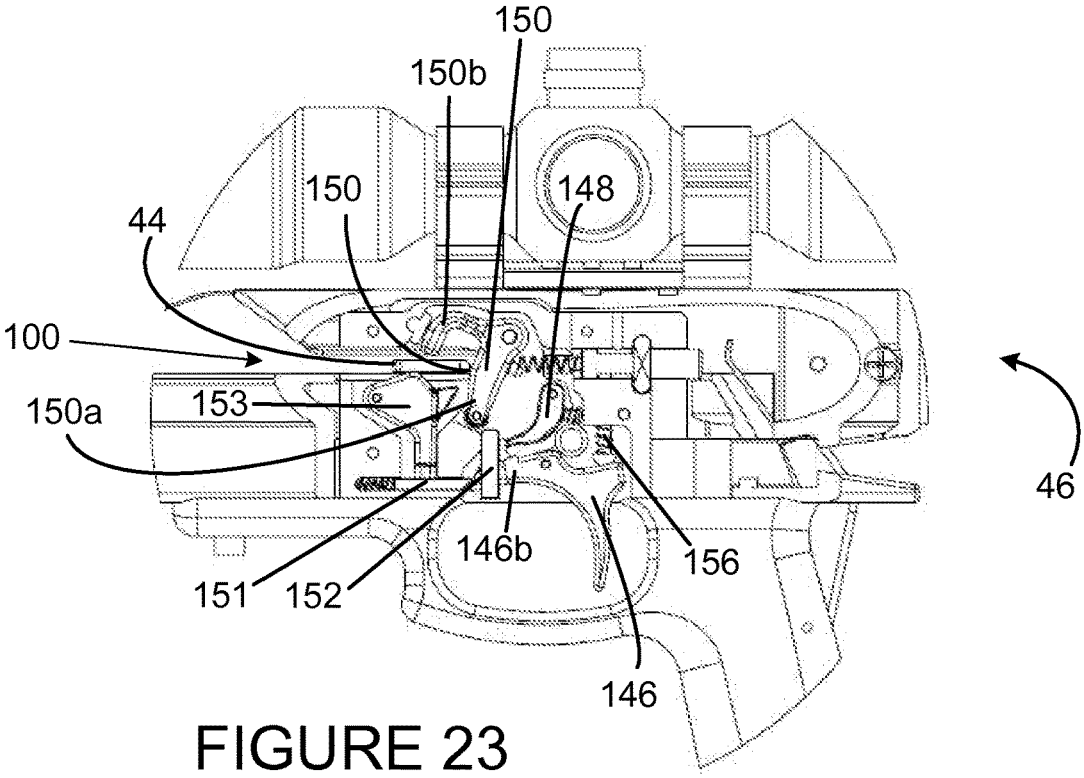
FIG. 23 is a partial sectional view of the trigger mechanism of FIG. 22, in a first position.
Figure 24:
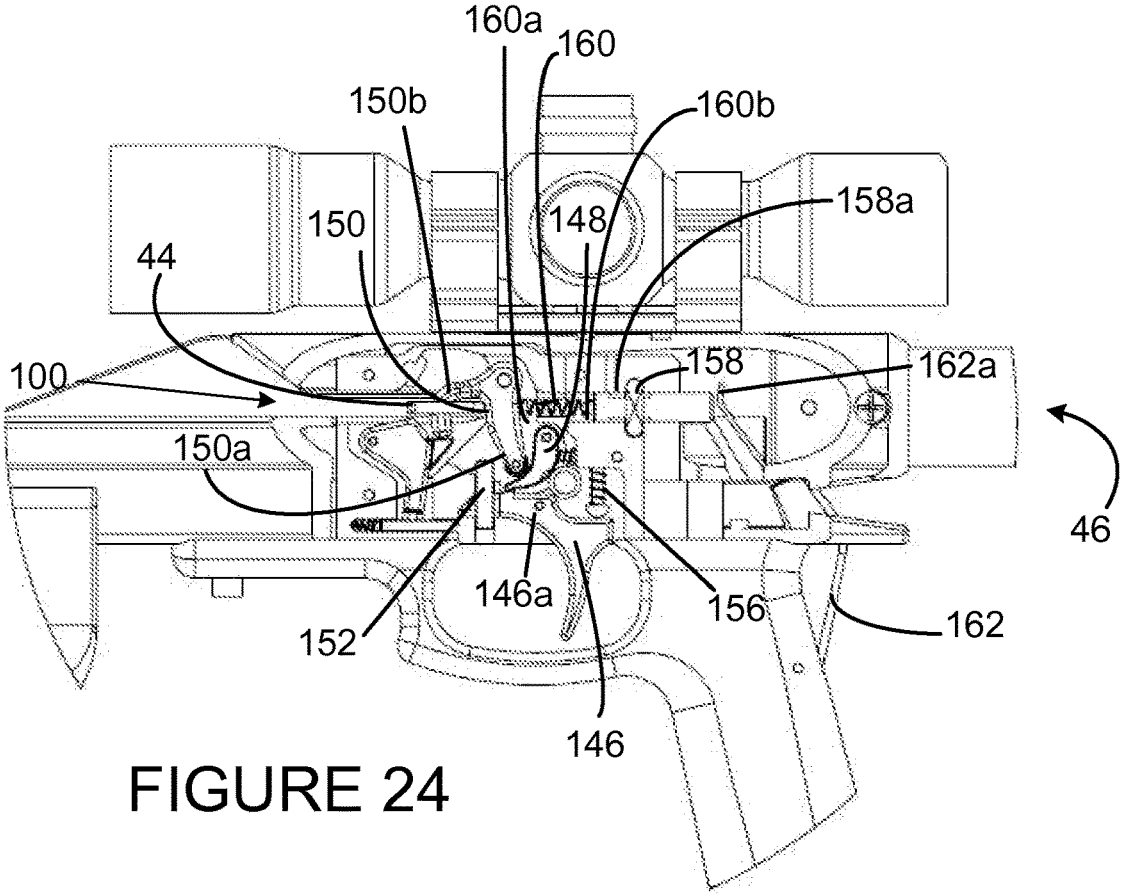
FIG. 24 is a partial sectional view of the trigger mechanism of FIG. 22, in a second position.

Referring to FIGS. 23 and 24, once the catch 150 rotates a sufficient distance in the counterclockwise direction, the catch second end 150*b* moves into a second position, as shown in FIG. 24, and retains the bowstring 44 since the block 152 prevents the catch 150 from further rotating in the clockwise direction. Specifically referring to FIG. 24, at this point the crossbow 10 is cocked and ready to be fired. However, the trigger 146 cannot be engaged (e.g., rotated counterclockwise or activated) to fire the crossbow without a bolt (not shown) is knocked on the bowstring 44. That is, a dry-fire safety pin 151, connected to a pivoting catch 153, is positioned under the trigger end 146*b* preventing the trigger from rotating. When a bolt is inserted into the slot 100, the bolt engages the pivoting catch 153, which causes the catch to rotate and move the pin out of engagement with the trigger end 146*b*. This configuration prevents the crossbow from being accidently dry-fired. Once the dry-fire safety is released, the user must push a spring loaded safety rod 158 forward so that a recess 158*a* formed on the safety rod 158 aligns with an end 156*a* of the spring loaded plunger 156. That is, when the safety rod recess 158*a* aligns with the spring loaded plunger end 156*a*, the plunger can move upward allowing the trigger to be pulled backward and rotated counterclockwise.

The safety rod 158 is retained in a "safety on" position (e.g., cannot be fired) by an expansion spring 160 having one end 160*a* abut against the bowstring catch 150 and a second end 160*b* abut against the end of the safety rod 158. Thus, in order to move the safety rod into the firing position, the user must grip the pistol grip 20 and squeeze the pistol grip, which in turn forces a safety lever 162 toward the pistol grip 20 causing an end of the safety lever 162*a* to force the safety rod 158 toward the catch 150 against the bias of the expansion spring 160. As a result, as the safety rod 158 is forced forward with respect to the spring loaded plunger 156, the safety rod recess 158*a* aligns with the spring loaded plunger end 156*a* allowing the trigger 146 to rotate in the counterclockwise direction.

Figure 25:
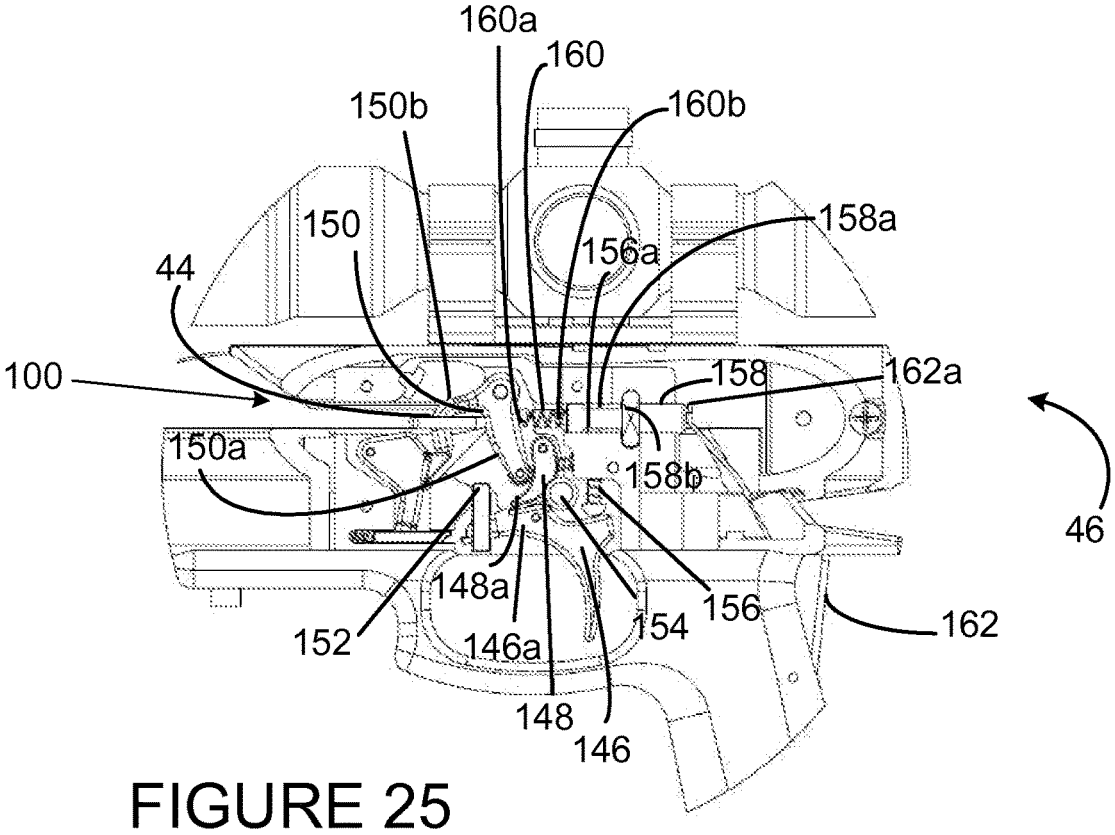
FIG. 25 is a partial sectional view of the trigger mechanism of FIG. 22, in a third position.

Referring to FIG. 25, if the user desires to release the bowstring without dry firing the crossbow by engaging the trigger, the user can place the crossbow trigger mechanism 46 into a release mode by pulling the slidable pin 154 outward, which aligns a recessed area 148*b* (FIG. 22) of the pivoting lever with the second portion (not shown) of the slidable pin 154. Once the pin 154 is a rope cocking device that engages the safety lever, which in turn moves the safety rod 158 so that the safety rod recess 158*a* aligns with the spring loaded plunger end 156*a*. The user can then begin drawing the bowstring 44 deeper into slot 100, which causes the catch 150 to rotate counterclockwise as the bowstring exerts force against the catch.

As the catch 150 rotates counterclockwise, the catch first end 150*a* exerts force against the pivoting lever 148 causing the pivoting lever to rotate counterclockwise about a pivot pin 148*a* (FIG. 22) so that the pivoting lever end 148*a* engages in the trigger recess 146*d* (e.g., a detent) (FIG. 22). As the pivoting lever 148 rotates counterclockwise, the pivoting lever end 148*a* exerts force against the trigger end 146*b* thereby causing the trigger 146 to also rotate counterclockwise. Furthermore, as the trigger 146 rotates counterclockwise, the trigger end 146*a* causes the block 152 to move downward out of the path of the catch first end 150*a*. The counterclockwise rotation of the various parts continues until the spring loaded plunger end 156*a* moves fully into the safety rod recess 158*a*.

Figure 26:
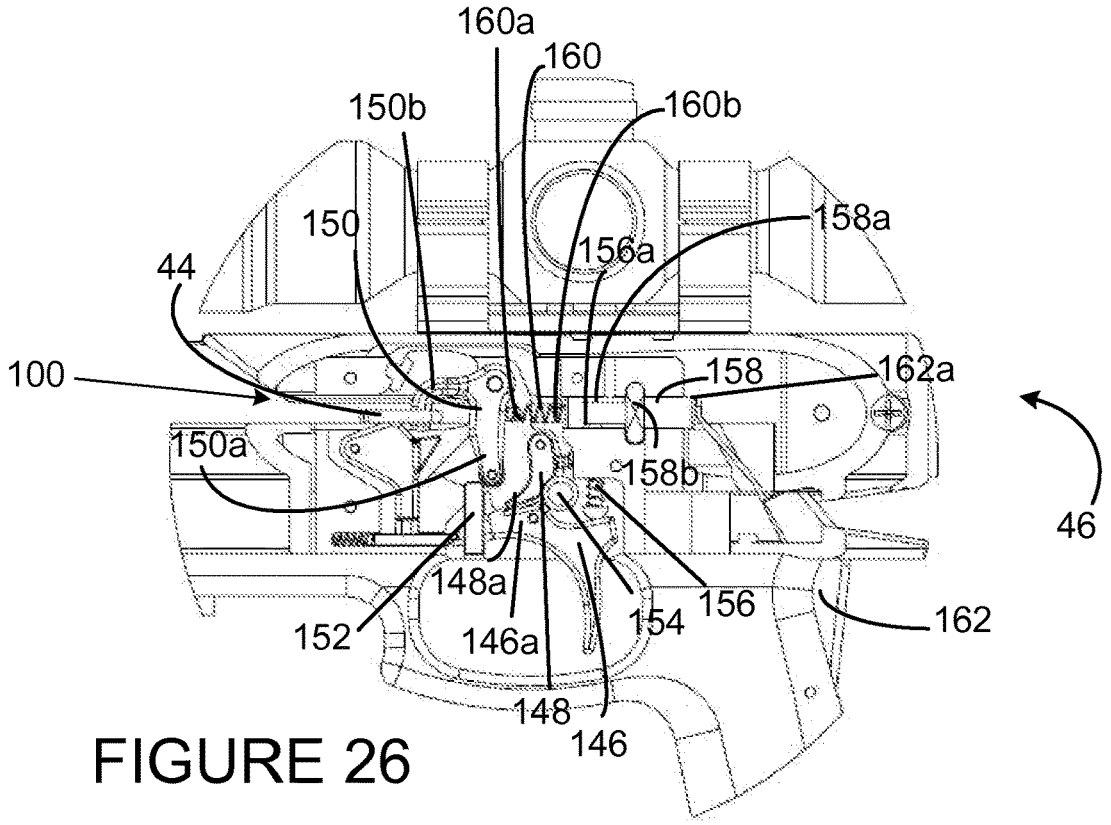
FIG. 26 is a partial sectional view of the trigger mechanism of FIG. 22, in a fourth position.
Figure 27:
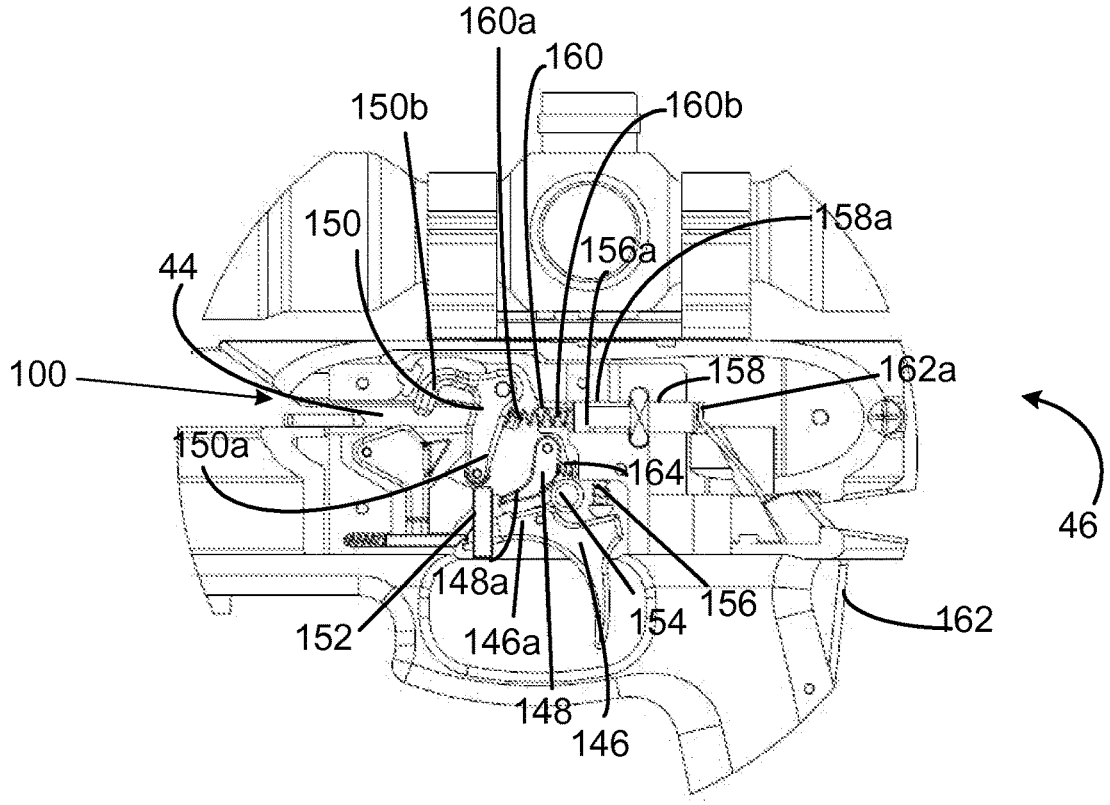
FIG. 27 is a partial sectional view of the trigger mechanism of FIG. 22, in a fifth position.

Referring to FIGS. 26 and 27, as the user allows the bowstring 44 to move forward, the bowstring reengages with the catch second end 150*b* and causes it to rotate clockwise until the bowstring catch first end 150*a* rides over the block 152 at which point the catch 150 can freely rotate in the clockwise direction allowing the bowstring 44 to be moved into the un-cocked position. Additionally, as the catch first end 150*a* rides over the block 152, it forces the block downward, which causes the trigger 146 to slightly rotate counterclockwise a sufficient distance to allow the pivoting lever end 148*a* to move out of the trigger recess 146*d* (FIG. 22) since a spring 164 biases the pivoting lever 148 in the clockwise direction. Finally, once the pivoting lever end 148*a* fully disengages from the trigger recess 146*d*, the trigger rotates in the clockwise direction allowing the spring loaded pin 156 to move out of the safety rod recess 158*a* thereby allowing the safety rod 158 to move back into the "safety on" position.

Third Embodiment

Figure 28:
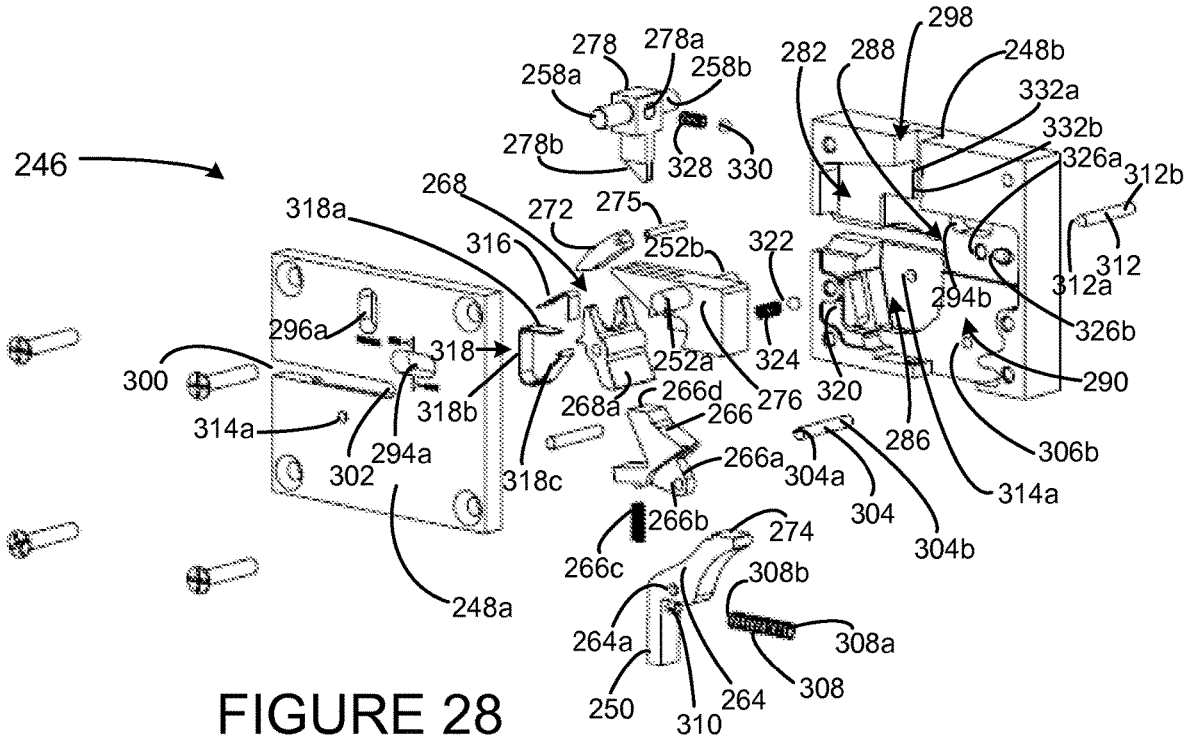
FIG. 28 is a front plan view of an embodiment of a trigger mechanism for use with the crossbow of FIG. 1.

Referring to FIG. 28, another embodiment of a trigger mechanism is shown. In particular, the trigger mechanism 246 comprises a trigger 250 coupled to a trigger lever 264 having a first arm 274. A trigger second arm 266 is pivotally coupled to the trigger lever 264. The trigger lever 264 and the trigger second arm 266 are pivotally received in a recessed area 290. A safety block 276 is slidably received in the first and second housing portions 248*a* and 248*b*. A disarm block 278 is also slidably received in the first and second housing portions 248*a* and 248*b*.

The first and second housing portions 248*a* and 248*b* are generally square shaped and made from aluminum. In various embodiments, the housing 248 may be formed in any shape (e.g., rectangular, polygonal, oval, etc.) and may be formed from any suitable material (e.g., alloy, stainless steel, ceramic, polymers, etc.). Each housing portion 248*a* and 248*b* contains a first elongated slot 294*a* and 294*b* that opens into a recessed area 288 and is configured to receive pins 252*a* and 252*b* formed on the safety block 276. A second set of elongated slots 296*a* and 296*b* (only 296*a* is shown in the figure) opens into the recessed area 298 (formed in each of housing portions 248*a* and 248*b*) and are configured to receive the respective pins 258*a* and 258*b*, which are formed on the disarm block 278. A bowstring slot 300 is formed through one side of each housing portion 248*a* and 248*b* and terminates proximate a center 302 of the housing 248 adjacent the bowstring catch 268.

As mentioned above, trigger lever 264 and trigger second arm 266 are pivotally mounted in recessed area 290 by a pin 304 that passes through a bore 264*a* formed through the trigger lever 264 and a bore 266*b* formed in a flange 266*a* on the trigger second arm 266. That is, a first end 304*a* of the pin is received in a blind bore (not shown) formed in first housing portion 248*a*, and a second end 304*b* of the pin 304 is received in a blind bore 306 formed in the second housing portion 248*b*. A spring 308 has a first end 308*a* that engages an inside wall of the second housing portion 248*b*, and a second end 308*b* that is received on a pin 310 formed proximate to the area where trigger 250 is coupled to the trigger lever 264. In various embodiments, the trigger may be integrally formed with the trigger lever, and in other embodiments, the trigger may be coupled to the trigger lever by any suitable fastener.

Catch 268 is pivotally mounted in recess 286 by a pin 312 that passes through a hole (not numbered). A first end 312*a* of the pin is received in a hole 314*a* formed through the first housing portion wall, and a second end 312*b* of pin 312 is received in a hole 314*b* formed through the second housing portion wall. The second end 268*b* of catch 268 is "U" shaped. The "U" shape allows a bolt (not shown) to be knocked on the bowstring without the catch second end 268*b* interfering with the bolt when the bowstring is pulled back and the cross bow is cocked. A flat spring 318 is positioned intermediate the catch first end 268*a* and the wall of the second housing portion 248*b*. More particularly, a first end 318*a* and an intermediate part 318*b* of the flat spring 318 are received in a groove 320 formed in the housing second portion 248*b*. A second end 318*c* of the flat spring 318 is positioned adjacent the catch first end 268*a* and biases the bowstring catch first end 268*a* into engagement with the trigger second arm 266.

Figure 29:
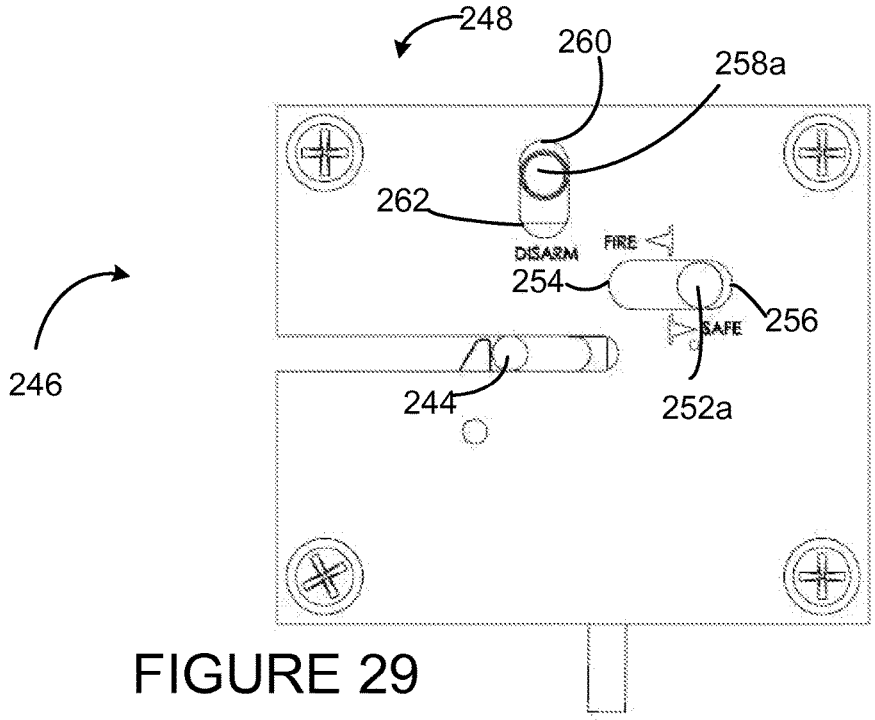
FIG. 29 is an exploded view of the trigger mechanism of FIG. 28.

The safety block 276 is slidably received in the recess 288 such that (1) pin 252*a* aligns with, and extends through, the slot 294*a* formed in first housing portion 248*a*, and (2) pin 252*b* aligns with, and extends through, slot 294*b* formed in second housing portion 248*b*. A first end of the safety block 276 defines a recess (not shown in FIG. 3) that is configured to pivotally receive the rotating lever 272. A spring 316 is positioned intermediate the safety block 276 and the rotating lever 272 and is configured to bias the rotating lever 272 in a clockwise direction about a pin 275. The safety block 276 is moveable between a first fire position 254 (FIG. 29) and a second safety position 256 (FIG. 29). The safety block 276 is maintained in the first and second positions by a spring 324 and ball 322 that are operatively received in a blind bore (not shown) formed in the side of the safety block 276. The ball 322 is configured to engage with one of two semispherical bores 326*a* and 326*b* formed in a wall that defines the recess 288.

The disarm block 278 is slidably received in the recess 298 such that (1) pin 258 aligns with, and extends through, slot 296*a* formed in the first housing portion 248*a*, and (2) pin 258*b* aligns with, and extends through, the slot (not shown) in the second housing portion 248*b*. The disarm block 278 is slidable between a first neutral position 260 (FIG. 29) and a second disarm position 262 (FIG. 29). The disarm block is maintained in either the first or second positions by a spring 328 and ball 330 that is operatively received in a blind bore 278*a* formed in the disarm block 278. The spring loaded ball 330 operatively engages with one of two semispherical bores 332*a* and 332*b* formed in a side wall of the recess 298, which locks the disarm block in one of the neutral or disarm positions.

FIGS. 29-37 show an exemplary trigger mechanism 246. While trigger mechanisms exist in many guns and weapons, in this exemplary embodiment, the trigger mechanism 246 provides a release mechanism that allows a user to release a cocked crossbow without having to dry fire the weapon or engage the trigger.

Cocking the Crossbow

Figure 30:
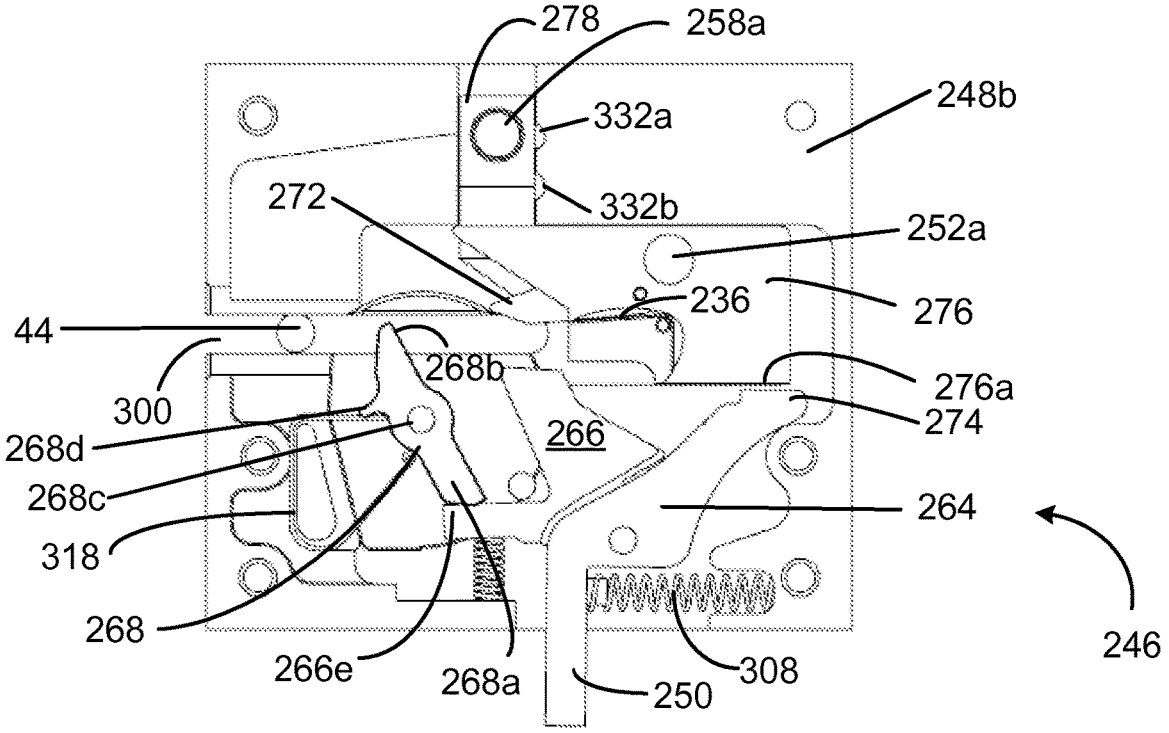
FIG. 30 is a front plan view of an embodiment of a trigger mechanism for use with the crossbow of FIG. 28 in a first position.

Specifically referring to FIG. 29, the trigger mechanism 246 is shown with the disarm pin 258*a* in an neutral first position 260, and the safety pin 252*a* in a safety position 256. Referring to FIG. 30, the trigger mechanism of FIG. 29 is shown with the housing first portion 248*a* removed. In the present configuration, the ball 330 (FIG. 28) is engaged in the recesses 332*a* and the ball 322 (FIG. 28) is engaged in recess 326*b* (FIG. 28). The bowstring 44 is shown positioned inside slot 300 as the user is moving the bowstring into a cocked position. The flat spring 318 biases the catch 268 in the counterclockwise direction until a second end 268*b* abuts a first finger 266*e* of the trigger second arm 266, and the spring 308 biases the trigger lever 264 in a clockwise direction until the trigger lever first arm abuts the inside wall of the second housing portion 248*b*. The rotating lever 272 is biased clockwise by a flat spring 236 so that the rotating lever is positioned substantially out of slot 300. Finally, because the safety block is in the safety position, the trigger lever first arm 274 abuts a bottom edge 276*a* of the safety block thereby preventing the trigger lever 264 from rotating in the counterclockwise direction.

Figure 31:
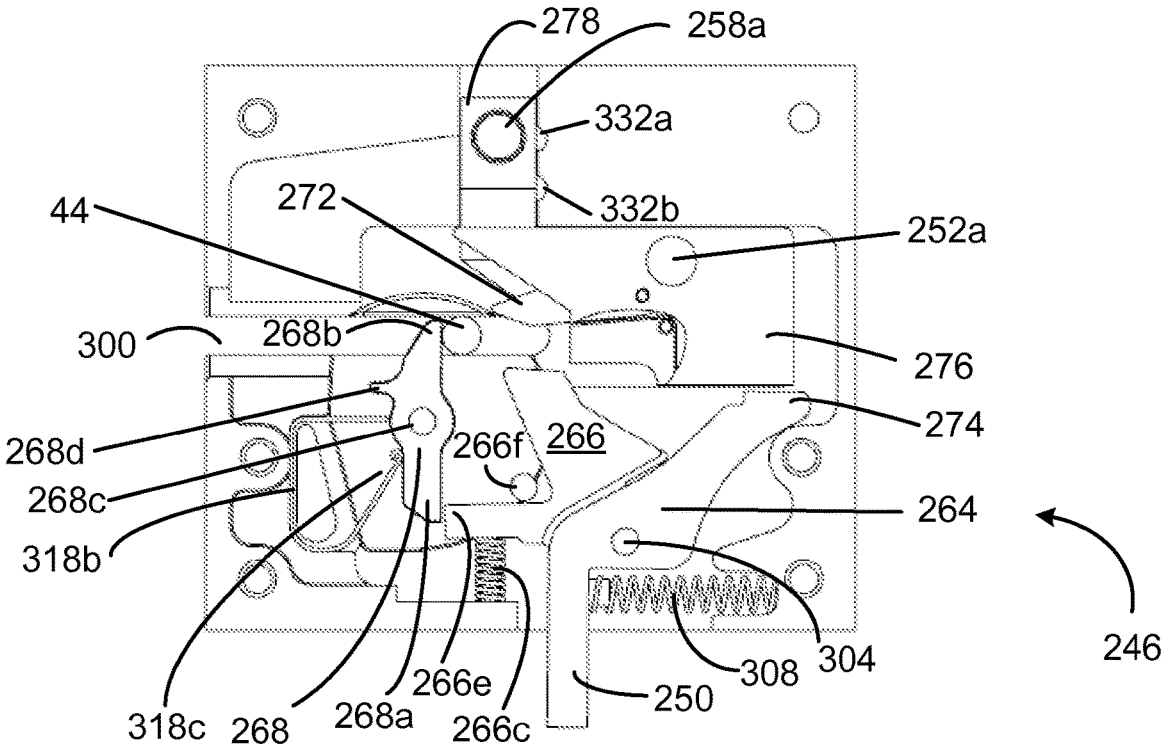
FIG. 31 is a partial sectional view of the trigger mechanism of FIG. 28, in a second position.

Referring to FIG. 31, as the bowstring 44 is pulled further into the slot 300, the bowstring engages the catch second end 268*b* causing the catch to rotate clockwise about the pivot pin 268*c*. As the catch 268 rotates, the catch first end 268*a* pushes against the first finger 266*e* causing the trigger second arm 266 to rotate counterclockwise against the upward bias of spring 266*c*. Continued rotation of the catch

268 causes the catch first end 268*a* to move to the left of the first finger 266*e* against the bias of the flat spring second end 318*c*. This allows the first finger 266*e* to rotate clockwise until the first finger 266*e* abuts a stop 266*f*. In this position, the catch first end 268*a* is prevented from rotating counterclockwise by the first finger 266*e*. As a result, the crossbow is cocked and ready to be fired.

Firing the Crossbow

Figure 32:
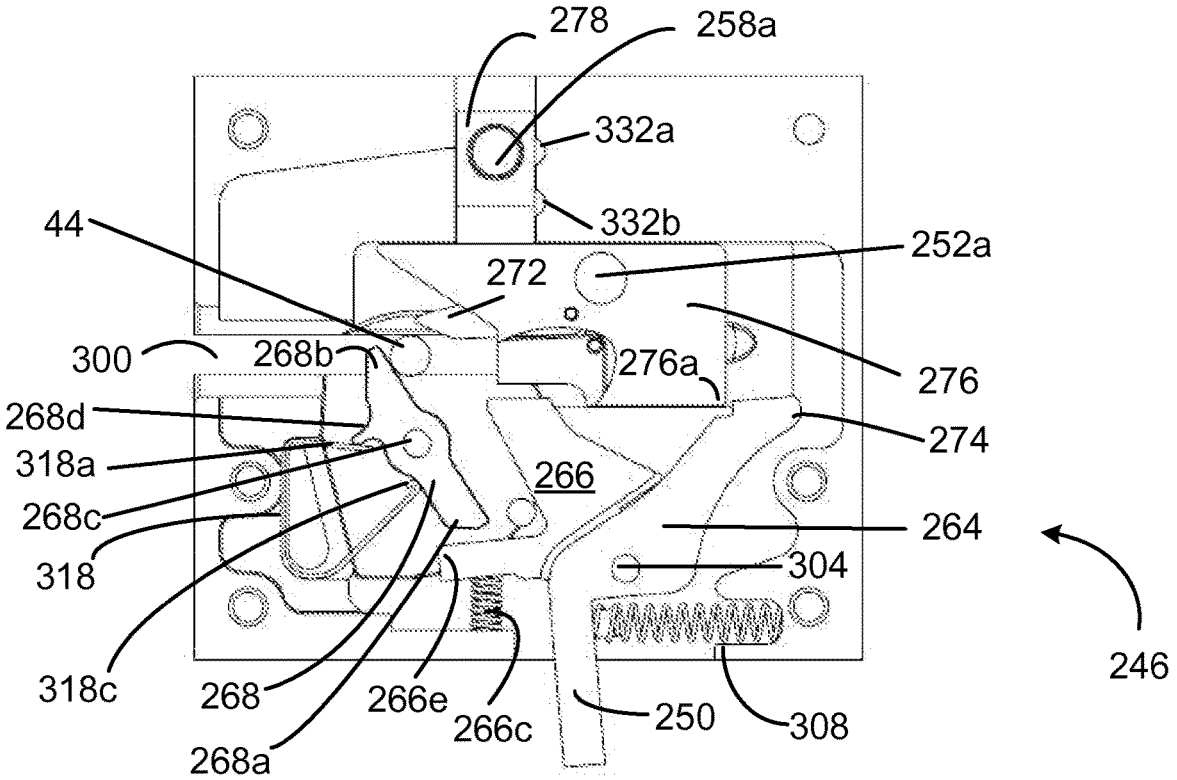
FIG. 32 is a partial sectional view of the trigger mechanism of FIG. 28, in a third position.
Figure 33:
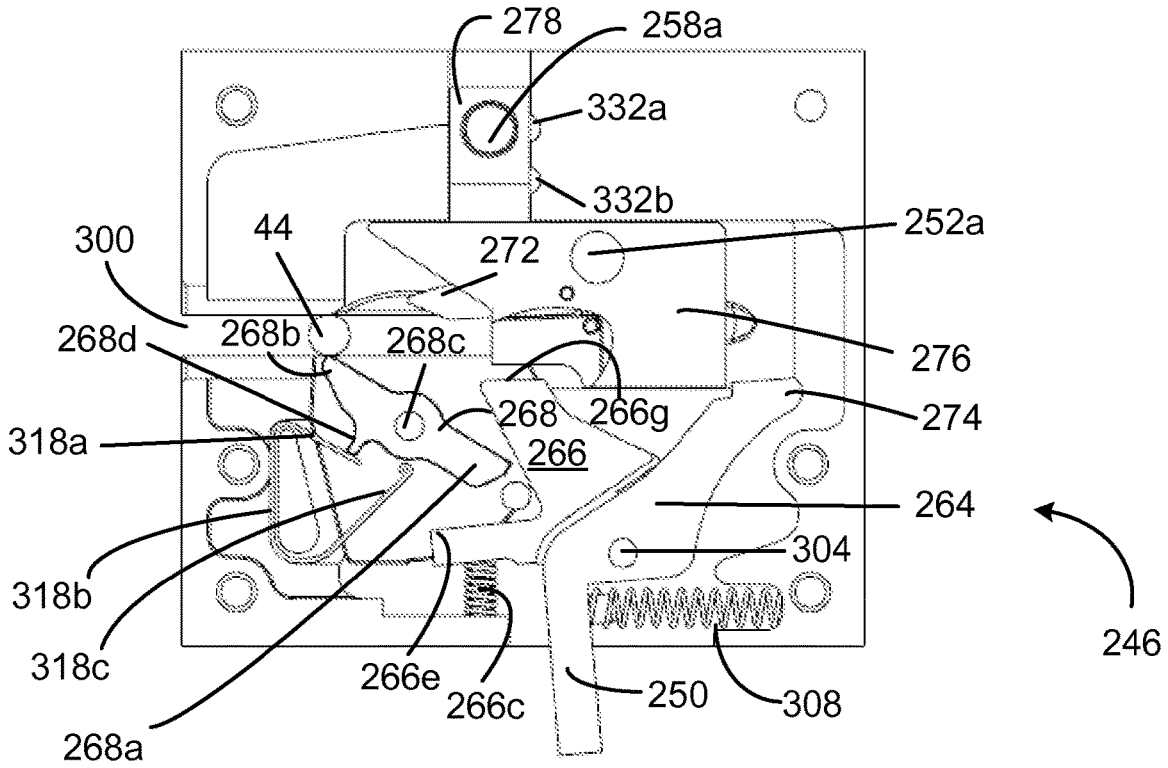
FIG. 33 is a partial sectional view of the trigger mechanism of FIG. 28, in a fourth position.

Referring to FIGS. 32 and 33, the user can fire the crossbow 10 by sliding the safety lever 276 forward using pin 252*a*. Once the safety lever is moved forward, the user can engage the trigger 250 by pulling the trigger toward the right (as shown in FIGS. 32 and 33). As the trigger 250 is pulled to the right, the trigger lever 264 rotates counterclockwise so that the first arm 274 moves up and behind the safety block 276. In addition to the trigger lever 264 rotating about pin 304, the trigger second arm 266 also rotates counterclockwise about pin 304 so that the first finger 266*e* exerts downward force against spring 266*c*. Once the first finger 266*e* moves a sufficient distance down and away from the catch first end 268*a*, the catch is free to rotate counterclockwise from the force of the bowstring 44 pulling to the left (as shown in the figures). As shown in FIG. 33, the catch 268 rotates a sufficient distance to allow the bowstring 44 to move out of the slot 300. Once the bowstring 44 moves past the catch 268, the spring first end 318*a* biases the catch 268 in the clockwise direction until it returns to the position shown in FIG. 30.

Releasing the Crossbow

Figure 34:
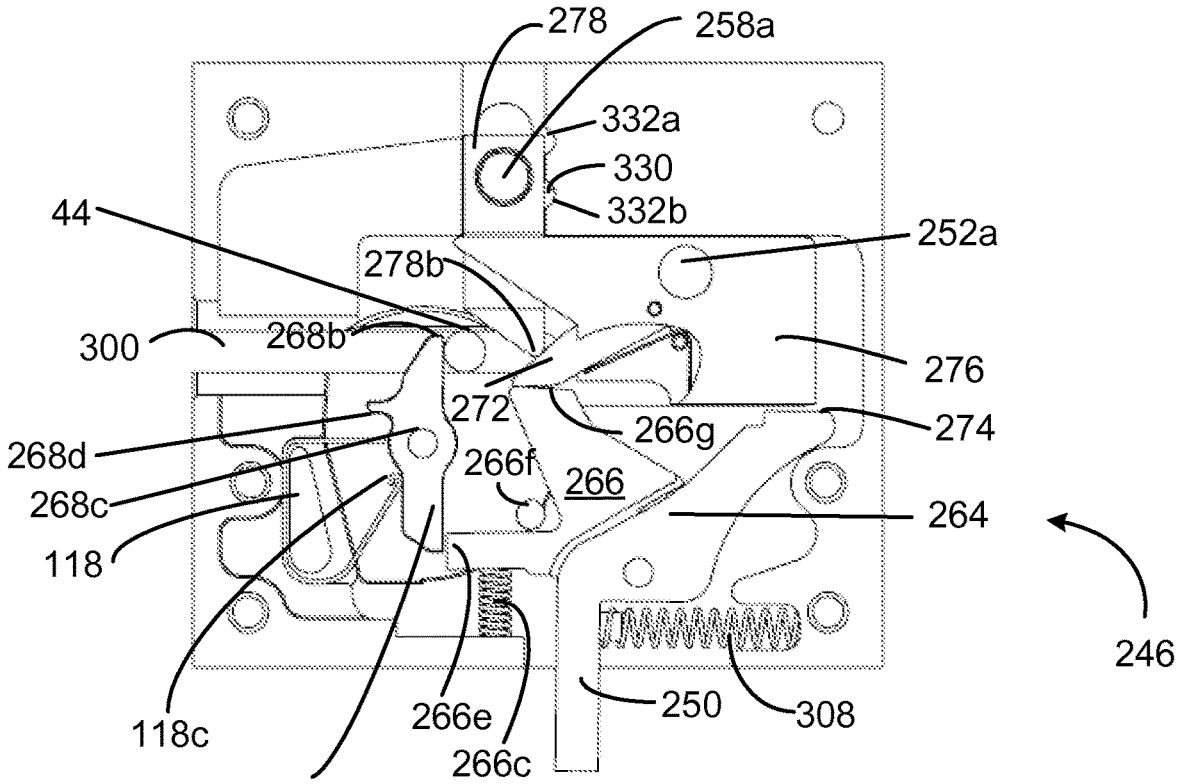
FIG. 34 is a partial sectional view of the trigger mechanism of FIG. 28, in a fifth position.
Figure 35:
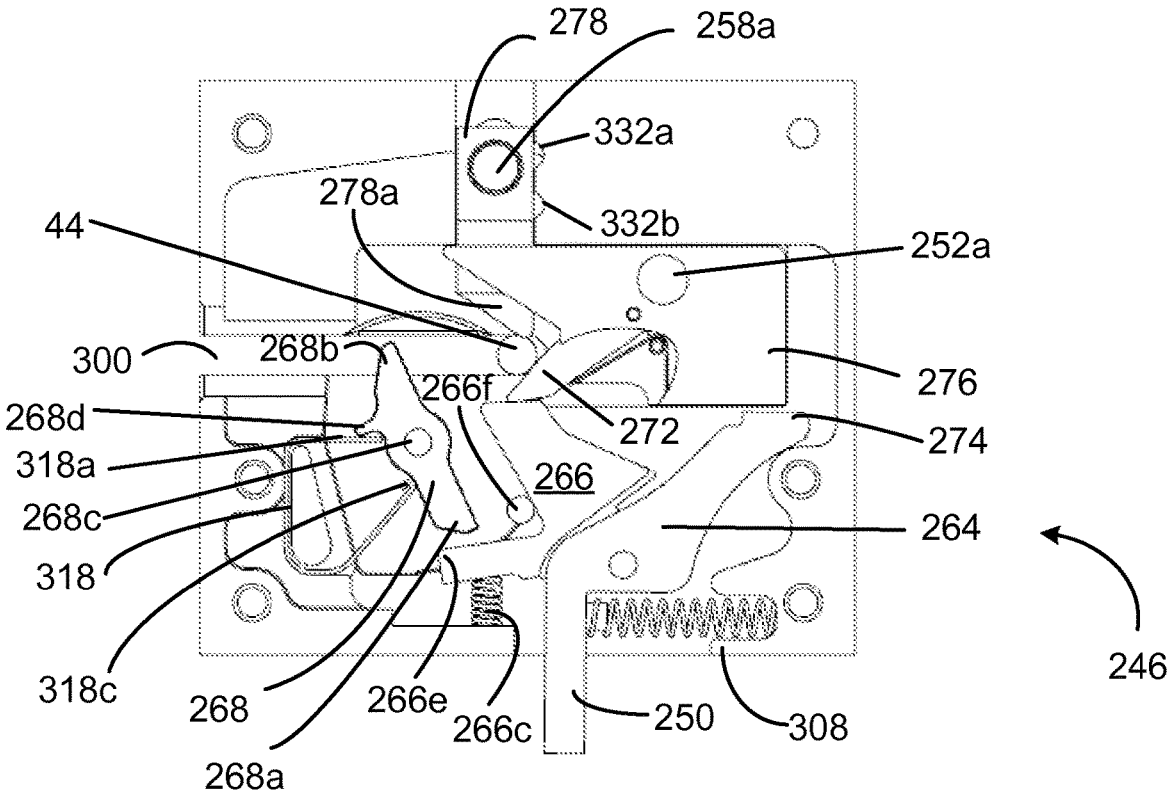
FIG. 35 is a partial sectional view of the trigger mechanism of FIG. 28, in a sixth position.

Referring to FIGS. 34 and 35, if instead of firing the crossbow the user wishes to release the bowstring from the cocked position without having to dry-fire the crossbow, the user can use the disarm mechanism. Firstly, the user moves the disarm block 278 from the first neutral position into the second disarm position so that the spring loaded ball 330 moves from the first hemispherical bore 332*a* into the second hemispherical bore 332*b*, which retains the disarm block 278 in the second disarm position. As the disarm block moves, a first end 278*b* of the disarm block 278 engages a top surface of the rotating lever 272 causing the lever to rotate counterclockwise into engagement with a second finger 266*g* of the trigger second arm 266. It should be noted that even though the trigger mechanism is placed in the disarm position, as described above; the catch 268 continues to maintain the bowstring 44 in the cocked position.

Referring particularly to FIG. 35, the user pulls the bowstring 44 to the right, deeper into the slot 300, so that the bowstring engages with the rotating lever 272, which forces it to rotate counterclockwise while imparting downward force on the second finger 266*g*. The downward force on the second finger 266*g* causes the trigger second arm 266 to also rotate counterclockwise (with respect to the trigger lever 264) compressing the spring 266*c*. As the trigger second arm 266 rotates counterclockwise, the first finger 266*e* moves out of engagement with the catch first end 268*a*. The movement of the first finger 266*e* allows the catch 268 to rotate counterclockwise as the flat spring second end 318*c* moves away from the flat spring body 318*b*, which causes the catch first end 268*a* to move above the first finger 266*e*, as shown in FIG. 35. Additionally, the bowstring 44 also engages the disarm block first end as it is being pulled back, which forces the disarm block back into the neutral first position where the spring loaded ball engages the hemispherical bore 332*a*.

Figure 36:
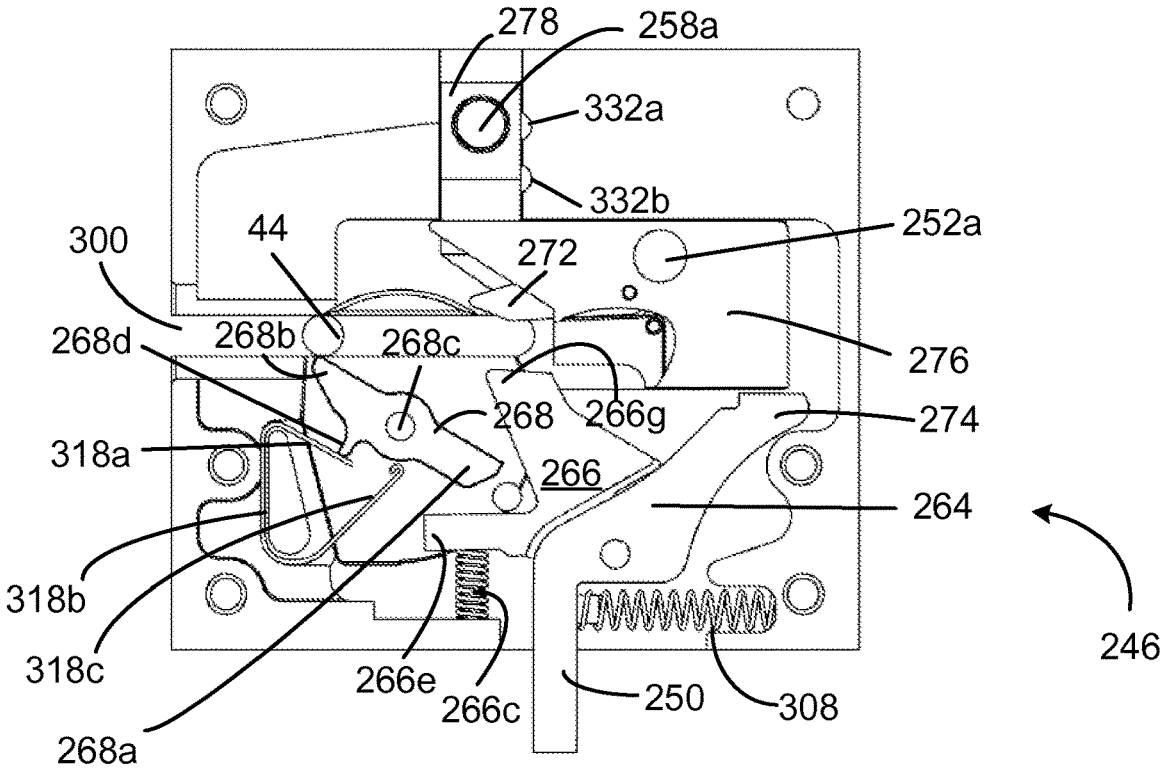
FIG. 36 is a partial sectional view of the trigger mechanism of FIG. 28, in a seventh position.

Referring to FIG. 36, once the catch first end 268*a* moves out of engagement with the first finger 266*e*, the trigger second arm 266 rotates clockwise from the force exerted by the spring 266*c* until the first finger 266*e* abuts the stop 266*f*. Furthermore, the user may then slowly begin to move the bowstring 44 out of the slot 300 since the first finger 266*e* no longer prevents the catch 268 from rotating counterclockwise. As the bowstring 44 forces the catch 268 to rotate counterclockwise by engaging the catch second end 268*b* as the bowstring 44 traverses the slot 300, the catch stop 268*d* engages the flat spring first end 318*a*, which causes the flat spring end 318*a* to compress.

Figure 37:
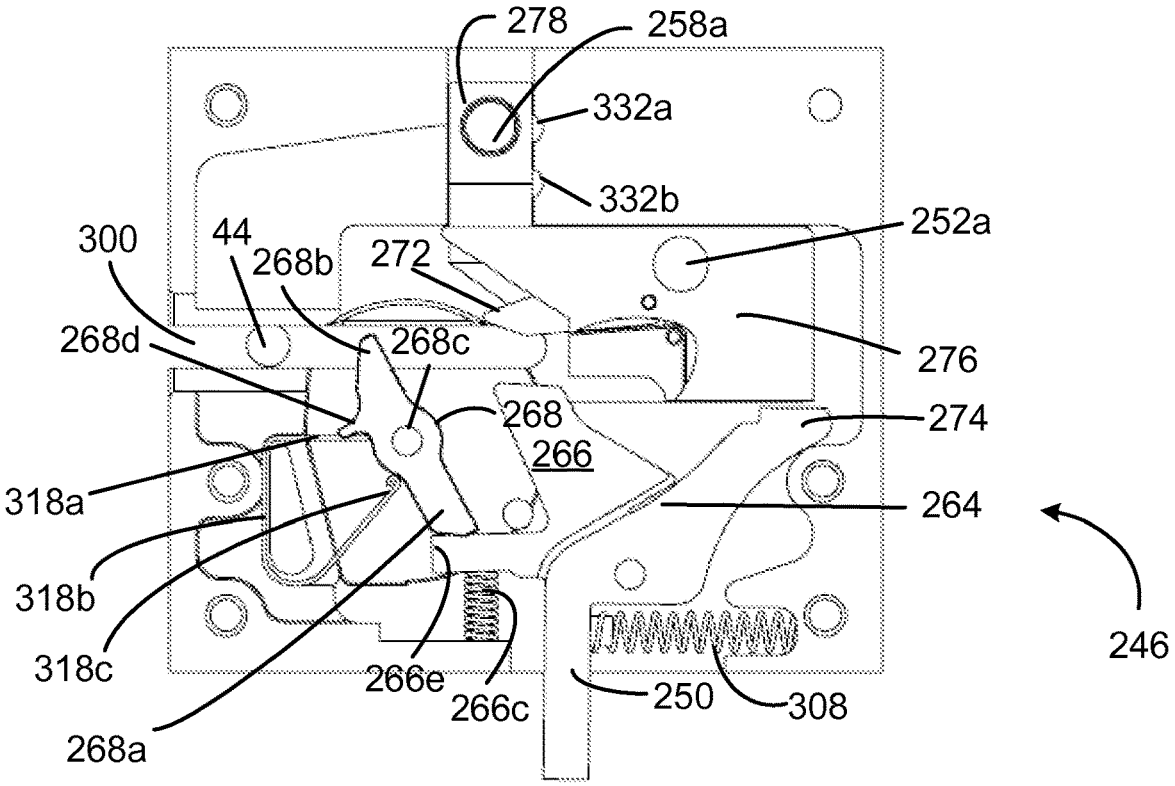
FIG. 37 is a partial sectional view of the trigger mechanism of FIG. 28, in an eighth position.

Referring to FIG. 37, once the bowstring 44 moves to the left of the catch second end 268*b*, the spring first end 318*a* exerts a force on the catch stop 268*d* causing the catch 268 to rotate in the clockwise direction until the catch first end 268*a* abuts the first finger 266*e*, as shown in FIG. 30. In this configuration, the crossbow is once again ready to be cocked.

CONCLUSION

Many modifications and other embodiments of the invention will come to mind to one skilled in the art to which this invention pertains having the benefit of the teachings presented in the foregoing descriptions and the associated drawings. For example, as will be understood by one skilled in the relevant field in light of this disclosure, the invention may take form in a variety of different mechanical and operational configurations as confirmed by the various embodiments disclosed herein. Therefore, it is to be understood that the invention is not to be limited to the specific embodiments disclosed and that the modifications and other embodiments are intended to be included within the scope of the appended exemplary concepts. Although specific terms are employed herein, they are used in a generic and descriptive sense only and not for the purposes of limitation. The description of the above exemplary embodiments should teach one of skill in the art that many more alternatives exist that can facilitate movement of the arrow rest launcher arm from the fired position into the arrow support position.

What is claimed:

1. A crossbow trigger comprising:

a housing;

a catch moveable with respect to the housing between a cocked position and a release position, the catch arranged to retain a bowstring in the cocked position and release the bowstring in the release position;

a trigger lever moveable with respect to the housing, the trigger lever comprising a body portion and an arm, the body portion comprising a finger trigger, the arm moveable with respect to the body portion, the arm contacting the catch and retaining the catch in the cocked position; and a disarm mechanism arranged to contact the trigger lever;

wherein the finger trigger is arranged to move the body portion and arm, thereby causing the arm to release the catch; and wherein the disarm mechanism is arranged to contact the trigger lever and move the arm to release the catch.

2. The crossbow trigger of claim 1, wherein the catch is arranged to move the arm with respect to the body portion as the catch moves to the cocked position.

3. The crossbow trigger of claim 1, wherein the disarm mechanism contacts the arm.

4. The crossbow trigger of claim 3, wherein the disarm mechanism does not contact the body portion.

5. The crossbow trigger of claim 1, wherein the arm is supported by the body portion.

6. The crossbow trigger of claim 1, wherein the body portion is arranged to rotate about a trigger axis and movement of the arm with respect to the body portion comprises a rotation of the arm about the trigger axis.

7. The crossbow trigger of claim 1, the housing comprising a slot, at least a portion of the disarm mechanism oriented in the slot.

8. The crossbow trigger of claim 1, wherein the disarm mechanism contacts the body portion.

9. The crossbow trigger of claim 1, comprising a safety moveable with respect to the housing between a safe position and a fire position.

10. The crossbow trigger of claim 9, comprising a disarm block moveable with respect to the housing, the disarm block having a neutral position and a disarm position, the disarm block arranged to retain the safety in its fire position when in the disarm position.

11. The crossbow trigger of claim 9, the safety comprising the disarm mechanism.

12. The crossbow trigger of claim 11, the safety comprising a body and the disarm mechanism, the disarm mechanism moveable with respect to the body.

13. The crossbow trigger of claim 12, the safety comprising a biasing mechanism arranged to bias the disarm mechanism to a predetermined orientation.

14. The crossbow trigger of claim 1, the disarm mechanism comprising a rotating lever.

15. The crossbow trigger of claim 1, the disarm mechanism arranged to contact the bowstring.

16. The crossbow trigger of claim 1, comprising a spring arranged to bias the arm to a predetermined position.

17. The crossbow trigger of claim 16, the spring supported by the body portion.

18. The crossbow trigger of claim 16, the spring supported by the housing.

* * * * *